US005964640A

United States Patent [19]

Barton et al.

[11] Patent Number: 5,964,640

[45] Date of Patent: Oct. 12, 1999

[54] TOY DUMP TRUCK WITH AUTOMATIC DUMPER MECHANISM

[75] Inventors: William M. Barton, Encinitas; Lonnie C. Pogue, San Diego; James A. Trinchera, Carlsbad, all of Calif.

[73] Assignee: Rokenbok Toy Company, Encinitas, Calif.

[21] Appl. No.: 08/797,186

[22] Filed: Feb. 11, 1997

[51] Int. Cl.[6] ..... A63H 17/39

[52] U.S. Cl. ..... 446/454; 463/62; 446/456; 446/470; 446/425

[58] Field of Search ..... 446/454, 456, 446/457, 470, 465, 431, 436, 491, 282, 434, 425; 463/39, 40, 62

[56] References Cited

U.S. PATENT DOCUMENTS

| | | | |
|---|---|---|---|
| 3,400,488 | 9/1968 | Phillpott et al. | 469/244 |
| 3,482,046 | 12/1969 | Hughson et al. | 179/154 |
| 3,596,400 | 8/1971 | Cheng | 46/235 |
| 3,639,755 | 2/1972 | Wrege | 246/187 B |
| 3,782,031 | 1/1974 | Byron | 46/244 R |
| 3,926,434 | 12/1975 | Cannon, Jr. | 373/86 B |
| 4,080,602 | 3/1978 | Hattori et al. | 343/225 |
| 4,087,799 | 5/1978 | Brouwer | 340/237.5 |
| 4,135,181 | 1/1979 | Bogacki et al. | 340/310 A |
| 4,171,468 | 10/1979 | Reiner | 179/15 AW |
| 4,334,221 | 6/1982 | Rosenhagen et al. | 340/825.72 |
| 4,817,948 | 4/1989 | Simonelli | 273/86 B |
| 4,925,427 | 5/1990 | Wu | 446/470 |
| 5,073,750 | 12/1991 | Coron | 318/58.7 |
| 5,098,110 | 3/1992 | Yang | 273/438 |
| 5,148,159 | 9/1992 | Clark et al. | 340/825.22 |
| 5,364,108 | 11/1994 | Esnouf | 273/430 |
| 5,372,534 | 12/1994 | Levy et al. | 446/470 |
| 5,435,768 | 7/1995 | Dunleavy | 446/427 |
| 5,452,901 | 9/1995 | Nakada et al. | 273/310 |
| 5,471,668 | 11/1995 | Soenen et al. | 455/352 |
| 5,474,486 | 12/1995 | Chilton et al. | 446/456 |
| 5,626,506 | 5/1997 | Halford et al. | 446/470 |
| 5,676,585 | 10/1997 | Nuermberger, III et al. | 446/470 |

*Primary Examiner*—Jessica J. Harrison
*Assistant Examiner*—James Schaaf
*Attorney, Agent, or Firm*—Ellsworth R. Roston; Fulwider Patton, et al.

[57] ABSTRACT

A remotely-controllable motorized toy vehicle having a highly-maneuverable skid steering system driven by single or dual motors, having a separately motorized scoop loading device pivotally secured to the chassis of the vehicle operative to load transportable elements into a automatically dumpable hopper mounted on the vehicle, having an automatic tow hitch mechanism with both the hopper and the hitching mechanism coupled to a motorized scoop gear train. The mechanical arrangement of the scoop gear train provides for the sequential actuation of the scoop for loading transportable elements into the hopper and both the hopper for dumping and the hitch mechanism for hitching and unhitching towed vehicles or trailers. The mechanisms and gear trains have proper ratios and dimensions preventing interference between the scoop and the hopper during forward and reverse actuation.

43 Claims, 8 Drawing Sheets

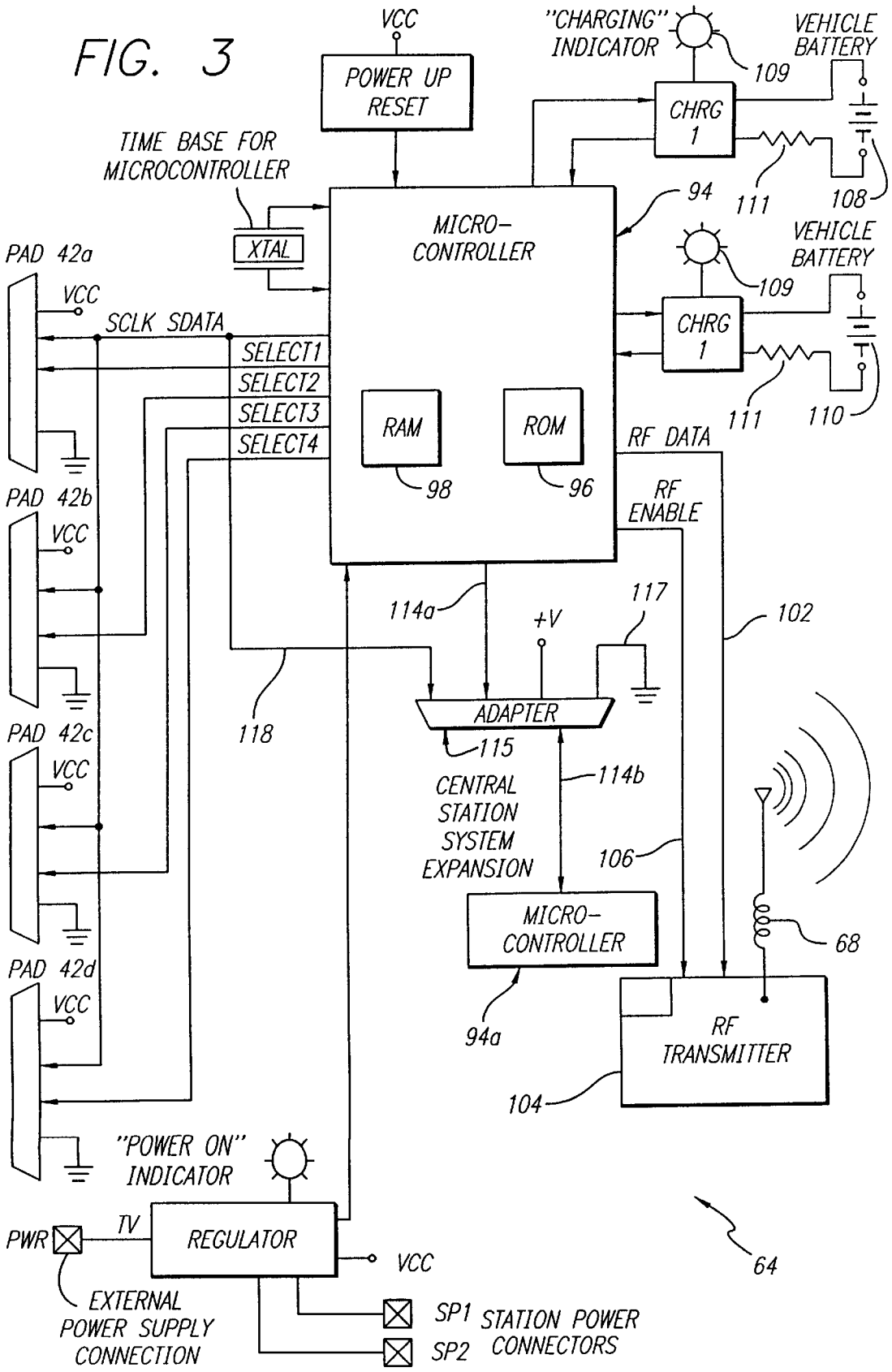
FIG. 3
VCC
POWER UP RESET
"CHARGING" INDICATOR
VEHICLE BATTERY
109
CHRG 1
TIME BASE FOR MICROCONTROLLER
XTAL
MICRO-CONTROLLER
94
111
108
VEHICLE BATTERY
109
CHRG 1
111
110
PAD 42a
VCC
SCLK SDATA
SELECT1
SELECT2
SELECT3
SELECT4
RAM
ROM
98
96
RF DATA
RF ENABLE
PAD 42b
VCC
114a
+V
117
102
118
ADAPTER
115
PAD 42c
VCC
CENTRAL STATION SYSTEM EXPANSION
114b
106
MICRO-CONTROLLER
68
PAD 42d
VCC
94a
RF TRANSMITTER
104
"POWER ON" INDICATOR
PWR
TV
REGULATOR
VCC
64
EXTERNAL POWER SUPPLY CONNECTION
SP1
SP2
STATION POWER CONNECTORS VCC
POWER UP RESET
122
VCC
134
12
TIME BASE FOR MICROCONTROLLER
XTAL
MICRO-CONTROLLER
RAM
ROM
126
124
VEHICLE ADDRESS SELECT
128
130
132
MOTOR 1
28
TRANSISTOR DRIVER
4
120
MOTOR 2
30
TRANSISTOR DRIVER
4
120
MOTOR 3
32
TRANSISTOR DRIVER
4
120
MOTOR 4
33
TRANSISTOR DRIVER
4
120
POWER ON
69
RF POWER MANAGEMENT
RF RECEIVER
121
BATTERY
VCC
4.5V
GND

TOY DUMP TRUCK WITH AUTOMATIC DUMPER MECHANISM

BACKGROUND OF THE INVENTION

1. Field of the Invention

This invention relates to a system for pleasurable use by people of all ages with youthful minds in operating remotely controlled vehicles simultaneously in a somewhat confined area. In the system of this invention, the vehicles can be remotely controlled to perform competitive or cooperative tasks. The system includes control pads for operation by the users, vehicles remotely controlled in accordance with the operation of the control pads and a central control station for coordinating the operation of the control pads and the vehicles. In addition to the inventive aspects of the system, each of the control pads, the central control station and the vehicles includes features of an inventive nature. The system of this invention also includes stationary plants (e.g. power plants and elevators) which are controlled by the operation of the control pads. The invention additionally relates to methods including methods for controlling the operation of the vehicles on a remotely controlled basis.

More specifically, this invention relates to remotely controlled vehicles having inventive features such as toy self-loading dump trucks, trailers, forklifts and bulldozers that can be operated to mimic the operation of similar full-size vehicles by employing highly-maneuverable skid steering, having automatic tow hitch actuation mechanisms and having motorized accessories for scooping up transportable elements, transferring the transportable elements to a hopper, automatically activating the hopper to dump the transportable elements, and for gripping, lifting and translating transportable elements.

2. Description of the Related Art

Various types of toy systems exist, and have existed for some time, in which vehicles are moved on a remotely controlled basis. Examples of a vehicle in such a system are an automobile, airplane, truck or construction vehicle. In most such systems, however, the functions and activities that the vehicle is capable of are limited to merely maneuvering a vehicle about on the ground, in the air or in the water. Other types of toy systems involve the use of blocks for building structures. These blocks often include structure for providing an interlocking relationship between abutting blocks. In this way, elaborate structures can be created by users with creative minds. However, such structures are generally built by hand manipulation of the blocks or hand manipulation of a mechanism of toy vehicle for handling the blocks.

Experience has proven that there is a desirability, and even a need, for play systems in which vehicles are remotely operated to perform functions other than merely being steered or maneuvered through a path of travel. For example, there exists a desire for a play system in which the remotely controlled vehicles have the capability of transporting elements such as building blocks maneuverable into position to build a toy or other structure. It is desirable that such systems employ a plurality of vehicles remotely controlled by switches in hand-held control pads so they can compete against one another in performing various tasks such as moving building blocks into place to build a miniature building.

Co-pending application Ser. No. 08/580,753 filed by John J. Crane on Dec. 29, 1995, for a "Remote Control System for Operating Toys" and assigned of record to the assignee of record of this application discloses and claims a play system for use by people of all ages with youthful minds. It provides for a simultaneous control by each player of an individual one of a plurality of remotely controlled vehicles. This control is provided by the operation by each such player of switches in a hand-held unit or pad, the operation of each switch in such hand-held unit or pad providing a control of a different function in the individual one of the remotely controlled vehicles. Each of the remotely controlled vehicles in the system disclosed an claimed in application Ser. No. 08/580,753 can be operated in a competitive relationship with others of the remotely controlled vehicles or in a co-operative relationship with others of the remotely controlled vehicles. The vehicles can be constructed to pick up and transport elements such as blocks or marbles and to deposit such elements at displaced positions.

When manually closed in one embodiment of the system disclosed and claimed in application Ser. No. 08/580,753, switches in pads control the selection of toy vehicles and the operation of motors for moving the vehicles forwardly, rearwardly, to the left and to the right and moving upwardly and downwardly (and rightwardly and leftwardly) a receptacle for holding transportable elements (e.g. marbles) or blocks.

When sequentially and cyclically interrogated by a central station, each pad in the system disclosed and claimed in application Ser. No. 08/580,753 sends through wires to the central station signals indicating the switch closures in such pad. Such station produces first binary signals addressing the vehicle selected by such pad and second binary signals identifying the control operations in such vehicle. Thereafter the switches identifying in such pad the control operations in such selected vehicle can be closed without closing the switches identifying such vehicle.

The first and second signals for each vehicle in the system disclosed and claimed in application Ser. No. 08/580,753 are transmitted by wireless by the central station to all of the vehicles at a common carrier frequency modulated by the first and second binary signals. The vehicle identified by the transmitted address demodulates the modulating signal and operates its motors in accordance with such demodulation. When the station fails to receive signals from a pad for a particular period of time, the vehicle selected by such pad becomes available for selection by another pad and such pad can select that vehicle or another vehicle.

A cable may couple two (2) central stations (one as a master and the other as a slave) in the system disclosed and claimed in application Ser. No. 08/580,753 so as to increase the number of pads controlling the vehicles. Stationary accessories (e.g. elevator) connected by wires to the central station become operative when selected by the pads.

Co-pending application Ser. No. 08/763,678 filed by William M. Barton, Jr., Peter C. DeAngelis and Paul Eichen on Dec. 11, 1996 for a "System For And Method Of Selectively Providing The Operation Of Toy Vehicles" and assigned of record to the assignee of record of this application discloses and claims a system wherein a key in a vehicle socket closes contacts to reset a vehicle microcontroller to a neutral state. Ribs disposed in a particular pattern in the key operate switches in a particular pattern in the vehicle to provide an address for the vehicle with the vehicle inactive but powered. When the vehicle receives such individual address from an individual one of the pads in a plurality within a first particular time period thereafter, the vehicle is operated by commands from such pad. Such individual pad operates such vehicle as long as such vehicle receives commands from such individual pad within the first particular period after the previous command from such individual pad. During this period, the vehicle has a first illumination to indicate that it is being operated.

When the individual pad of the system disclosed and claimed in application Ser. No. 08/763,678 fails to provide commands to such vehicle within such first particular time period, the vehicle becomes inactive but powered and provides a second illumination. While inactive but powered, the vehicle can be addressed and subsequently commanded by any pad including the individual pad, which thereafter commands the vehicle. The vehicle becomes de-activated and not illuminated if (a) the vehicle is not selected by any of the pads during a second particular time period after becoming inactivated but powered or, alternatively, (b) all of the vehicles become inactivated but powered and none is selected during the second particular period. The vehicle becomes de-activated and not illuminated. The key can thereafter be actuated to operate the vehicle to the inactive but powered state.

Co-pending application Ser. No. 08/696,263, filed by Peter C. DeAngelis on Aug. 13, 1996 for a "System And Method Of Controlling The Operation Of Toys" and assigned of record to the assignee of record of this application discloses and claims a system wherein individual ones of pads remotely control the operation of selective ones of vehicles. In each pad, (a) at least a first control provides for the selection of one of the vehicles, (b) second controls provide for the movement of the selected vehicle and (c) third controls provide for the operation of working members (e.g. pivotable bins) in the selected vehicle. Each pad provides a carrier signal, preferably common with the carrier signals from the other pads. Each pad modulates the carrier signal in accordance with the operation of the pad controls. The first control in each pad provides an address distinctive to the selected one of the vehicles and modulates the carrier signal in accordance with such address.

Each pad of the system disclosed and claimed in application 08/696,263 sends the modulated carrier signals to the vehicles in a pseudo random pattern, different for each pad, with respect to time. Each vehicle demodulates the carrier signals to recover the address distinctive to such vehicle. Each vehicle then provides a movement of such vehicle and an operation of the working members in such vehicle in accordance with the modulations provided in the carrier signal by the operation of the second and third controls in the pads selecting such vehicle. Each vehicle is controlled by an individual one of the pads for the time period that such pad sends control signals to such vehicle within a particular period of time from the last transmission of such control signals to such vehicle. Thereafter such vehicle can be selected by such pad or by another pad.

What has been needed, and heretofore unavailable, is a toy system including vehicles remotely operated to accomplish tasks such as lifting, scooping, dumping, leveling, and hauling suitably sized materials and towing of trailers carrying such material, or other vehicles, in combination to create a miniature community or industrial environment, thus providing a person having a youthful mind with the opportunity to employ a remotely-controlled system of vehicles and mechanisms to accomplish these tasks and others within a reduced-scale, industrial environment in cooperation or competition with other individuals in a pleasurable manner.

SUMMARY OF THE INVENTION

The toy vehicle disclosed herein comprises a wheeled, highly-maneuverable, motor driven skid steering, self-loading and dumping dump truck having the capability to releasably tow other vehicles and being compatible with a sophisticated remote-control system. Either single or dual motors are employed to drive the wheels and skid steering while only a single additional motor is employed to drive all of the other accessories and mechanisms. The toy dump truck includes a novel mechanical arrangement providing coordinated movement among a scoop, hopper and hitch mounted on the dump truck.

The toy dump truck is for use as part of a toy system for use by people of all ages with youthful minds. The system provides for a simultaneous control by each player of an individual one of a plurality of remotely controlled vehicles, including the dump truck. This control is provided by the operation by each such player of switches in a hand-held unit or control pad, the operation of each switch in such hand-held unit providing a control of a different function in the individual one of the remotely controlled vehicles.

Each of the remotely controlled vehicles in the system of this invention can be operated in a competitive or cooperative relationship with others of the remotely controlled vehicles or in a cooperative relationship with others of the remotely controlled vehicles. The vehicles can be constructed to pick up and transport elements such as blocks or marbles and to deposit such elements at displaced positions.

When manually closed in one embodiment of the invention, switches in control pads control the selection of toy vehicles and the operation of motors for moving the vehicles forwardly, rearwardly to the left and to the right and moving upwardly and downwardly (and rightwardly and leftwardly) a receptacle for holding transportable elements (e.g. marbles).

When sequentially and cyclically interrogated by a central control station, each control pad sends through wires to the station signals indicating the switch closures in such control pad. Such station produces first binary signals addressing the vehicle selected by such control pad and second binary signals identifying the motor control operations in such vehicle. Thereafter the switches identifying in such control pad the motor control operations in such selected vehicle can be closed without closing the switches identifying such vehicle.

The first and second signals for each vehicle are transmitted by wireless to all of the vehicles at a common carrier frequency modulated by the first and second binary signals. The vehicle identified by the transmitted address demodulates the modulating signals and operates its motors in accordance with such demodulation. When the station fails to receive signals from a control pad for a particular period of time, the vehicle selected by such control pad becomes available for selection by another control pad and such control pad can select that vehicle or another vehicle.

A cable may couple two (2) central control stations (one as a master and the other as a slave) to increase the number of control pads controlling by the vehicles. Stationary accessories (e.g. elevator) connected by wires to the central control station become operative when selected by the control pads.

BRIEF DESCRIPTION OF THE DRAWINGS

In the drawings, where like reference numerals indicate like or similar components, elements and features across the several figures:

FIG. 3 is a schematic diagram, primarily in block form, of the different features included in a central control station included in the system shown in FIG. 1;

DETAILED DESCRIPTION OF A PREFERRED EMBODIMENT

The drawings will now be described in more detail, wherein like referenced numerals refer to like or corresponding elements among the several drawings. Moreover, reference may be made to United States patent applications Ser. No. 08/580,753, Ser. No. 08/763,678 and Ser. No. 08/696,263, which are hereby incorporated in their entirety.

Figure 1:
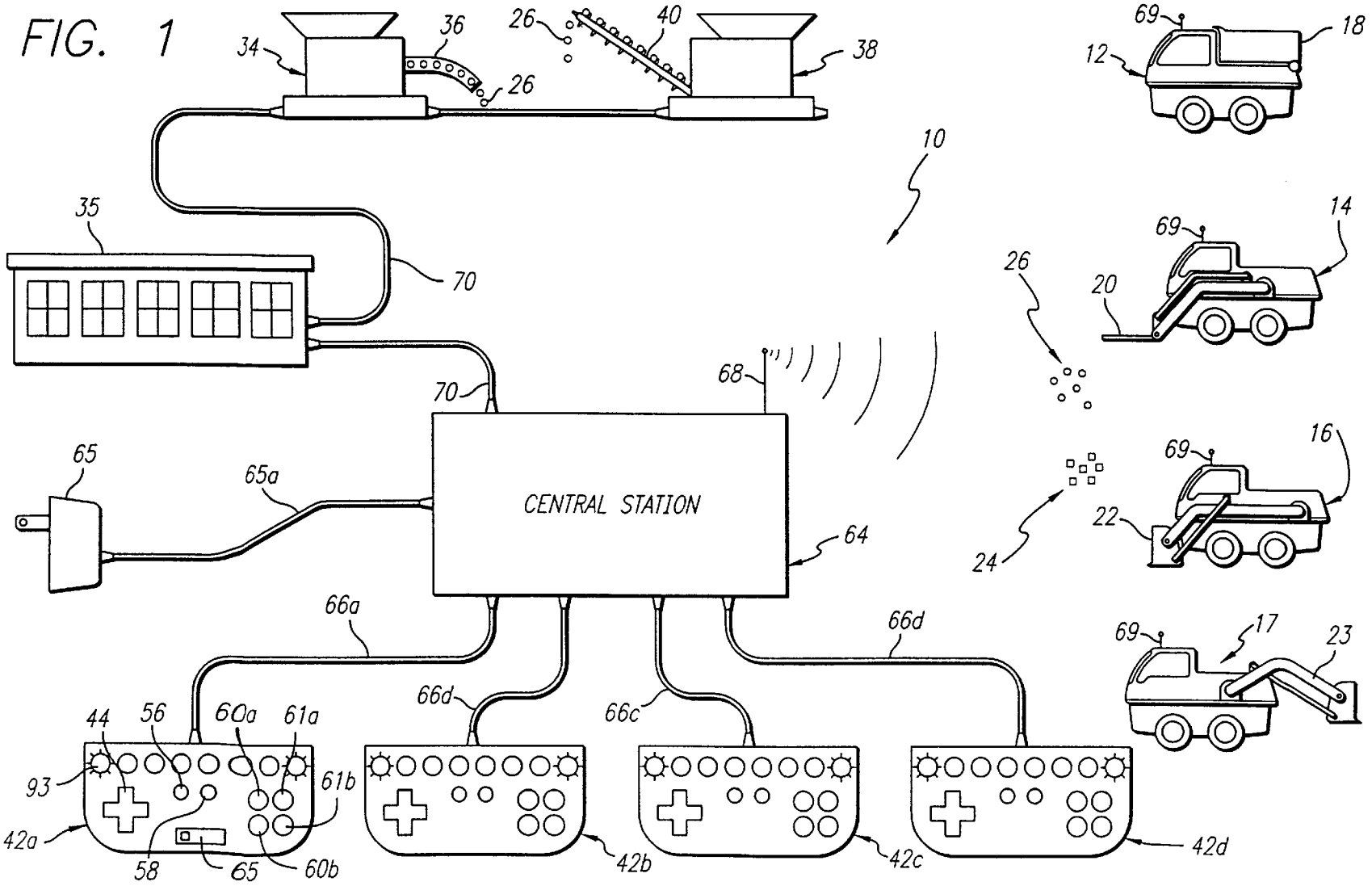
FIG. 1 is a schematic diagram of a system constituting one embodiment of the remote-control system invention.

In one embodiment of the invention, a system generally indicated at 10 in FIG. 1 is provided for controlling the selection and operation of a plurality of toy vehicles. Illustrative examples of toy vehicles constitute a dump truck, generally indicated at 12, a fork lift, generally indicated at 14, a skip loader, generally indicated at 16 and another form of skip loader, generally indicated at 17. The toy vehicles such as the dump truck vehicle 12, the fork lift 14 and the skip loaders 16 and 17 are simplified small scale replicas of corresponding full-size commercial units. For example, the dump truck vehicle 12 may include a working or transport member such as a pivotable tip up bin or container 18; the fork lift 14 may include a working or transport member such as a pivotable platform 20; the skip loader 16 may include a working or transport member such as a pivotable bucket 22 disposed at the front end of the skip loader; and the skip loader 17 may include a working or transport member such as a pivotable bin or container 23 disposed at the rear end of the skip loader. The working or transport members such as the pivotable bin or container 18, the pivotable platform 20 and the pivotable bins or containers 22 and 23 are constructed to carry storable and/or transportable elements such as blocks 24 or marbles 26 shown schematically in FIG. 1.

Each of the toy vehicles 12, 14, 16 and 17 may also have a trailer hitch 19 mounted on the front or rear of the vehicle for hooking a hitch member of another vehicle, such as trailer (not shown) to the hitch 19 of the vehicles 12, 14, 16 and 17. The trailer hitch 19 may be remotely controlled in similar fashion to the working or transport member of the toy vehicle. Alternatively, the trailer hitch may be mechanically interconnected with the working or transport member such that remote control of the working or transport member also controls the trailer hitch 19.

Figure 4:
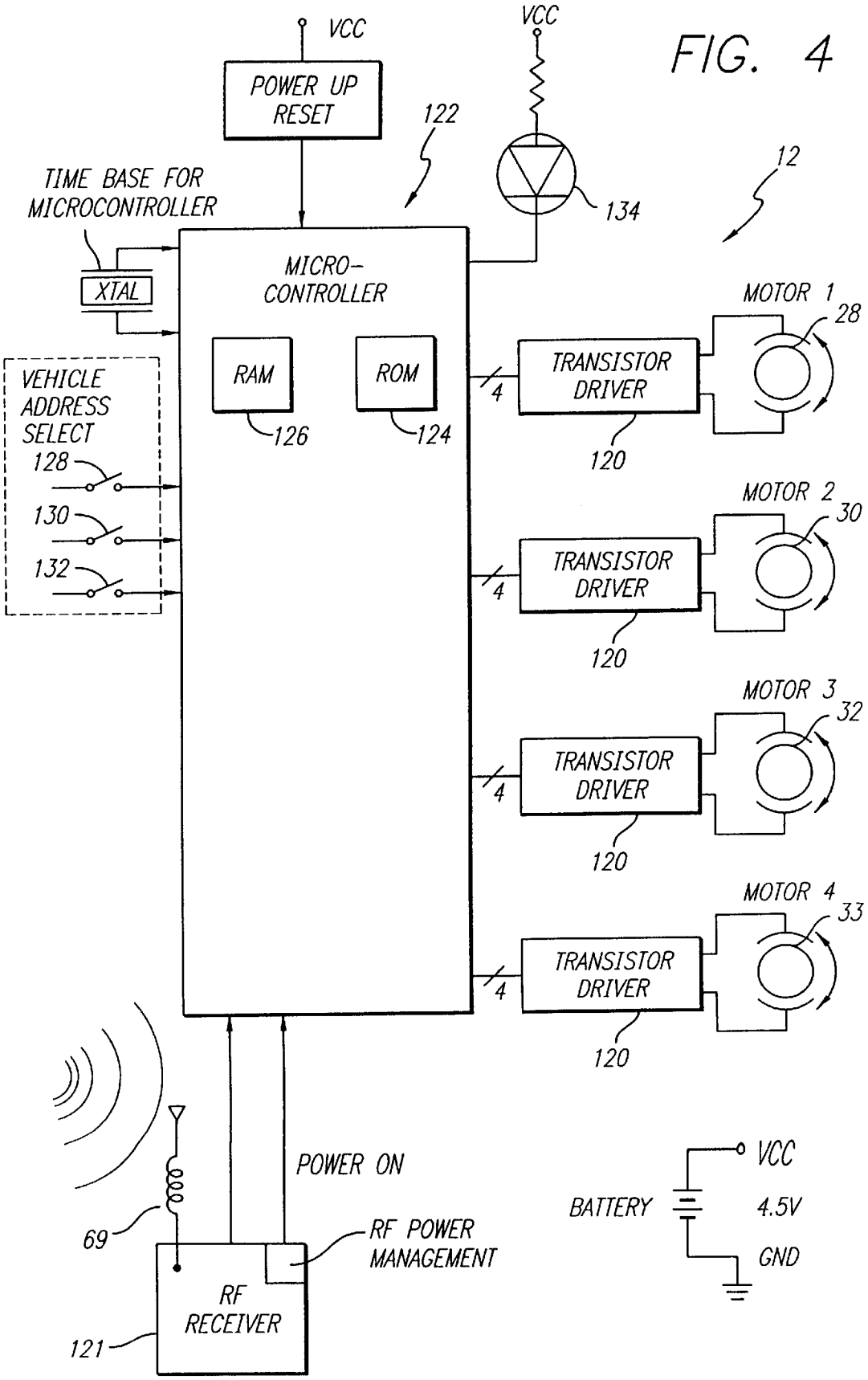
FIG. 4 is a schematic diagram, primarily in block form, of the different features in a vehicle included in the system shown in FIG. 1.

Each of the dump truck 12, the fork lift 14 and the skip loaders 16 and 17 may include a plurality of motors. For example, the dump truck 12 includes a pair of reversible motors 28 and 30 (FIG. 4) to move the dump truck vehicle forwardly or rearwardly and to pivot the vehicle to the right or to the left. The motor 28 drives the movement of the front and rear wheels on the left side of the dump truck 12, and the motor 30 drives the front and rear wheels on the right side of the dump truck 12.

When the motors 28 and 30 are simultaneously operated in one direction, the dump truck 12 moves forwardly. The dump truck 12 moves rearwardly when the motors 28 and 30 are moved in the opposite direction. The dump truck 12 turns toward the right when the motor 30 is operated without simultaneous operation of the motor 28. The dump truck 12 turns toward the right when the motor 28 is operated without a simultaneous operation of the motor 30.

The dump truck 12 spins to the right when the motor 30 operates to move the vehicle forwardly at the same time that the motor 28 operates to move the vehicle rearwardly. The dump truck 12 spins to the left when the motors 28, 30 are operated in directions opposite to the operations of the motors in spinning the vehicle to the right.

Another reversible motor 32 in the dump truck 12 operates in one direction to pivot the bin 18 about its rearward hinge 13 upwardly and in the other direction to pivot the bin downwardly. In another embodiment, continued rotation of the motor 32 to pivot the bin 18 in an upwardly direction may cause the trailer hitch 19 to open. When the motor 32 is operated in the other direction, the trailer hitch 19 closes and the bin 18 pivots downwardly. An additional motor 33 may operated in one direction to turn the bin 18 to the left and in the other direction to turn the bin 18 to the right.

The construction of the motors 28, 30, 32 and 33 and the disposition of the motors and controls in the dump truck 12 to operate the dump truck are considered to be well known in the art. The fork lift 14 and the skip loaders 16 and 17 may include motors to those described above for the dump truck 12.

The system 10 may also include remotely-controlled, motorized stationary plants or accessories. For example, it may include a remotely-controlled motorized pumping station, generally indicated at 34 (FIG. 1), and driven by a pumping motor responsive to a control (not shown), for pumping elements such as the marbles 26 from a hopper 34*a* through a conduit 36. The system may also include a remotely-controlled motorized conveyor, generally indicated at 38, and driven by a conveyor motor responsive to a control (not shown), for moving the elements such as the marbles 26 from a hopper 38*a* upwardly on a ramp 40. When the marbles 26 reach the top of the ramp 40, the elements such as the marbles 26 may fall into the bin 18 in the dump truck vehicle 12 or into the bin 22 in the skip loader 16 or 17. For the purposes of this application, the construction of the pumping station 34 and the conveyor 38 may be considered to be within the purview of a person of ordinary skill in the art. Accessories or stationary plants 34 and 38 may be connected to the central station 64 either directly or through a junction box such as miniature building 35 as shown in FIG. 1.

The system 10 may also include a plurality of hand held control pads, generally indicated at 42*a*, 42*b*, 42*c* and 42*d* (FIG. 1). Each of such control pads may have a substantially identical construction. Each of the control pads may include a plurality of actuatable buttons. For example, each of the control pads may include 4-way cruciform buttons 44 configured with four wings disposed over respective control buttons 44 arranged to drive individual ones of a plurality of switches 46, 48, 50, and 52 (FIG. 2).

One wing of the button 44 may be depressed to engage the button associated with the switch 46 to close the circuit in one direction through the motor 28 (FIG. 4) moving the selected one of the vehicle 12 forwardly. Similarly, the opposite wing of button 44 may be depressed, to close the switch 48 to close the circuit in the opposite direction through motor 28 (FIG. 4) moving the vehicle 12 rearwardly. The selective depression of the left and right segments of the button 44 closes the respective switches 52 and 50, in turn, respectively closing the circuit in one direction then the opposite direction through the respective motors 28 and 30 respectively turning the selected vehicle 12 toward the left and the right about its vertical axis.

It will be appreciated that the buttons 44 may be tilted in one diagonal direction or the other by simultaneously pressing two neighboring wings of buttons 44 to simultaneously close respective neighboring pairs of switches 46 (forward) & 50 (right) to obtain a simultaneous movement of the vehicle 12 forwardly and to the right. However, a simultaneous actuation of the top and bottom wings of the button 44 will not have any effect since such actuations represent contradictory commands. This is also true of a simultaneous actuation of the left and right wings of the button 44.

Figure 2:
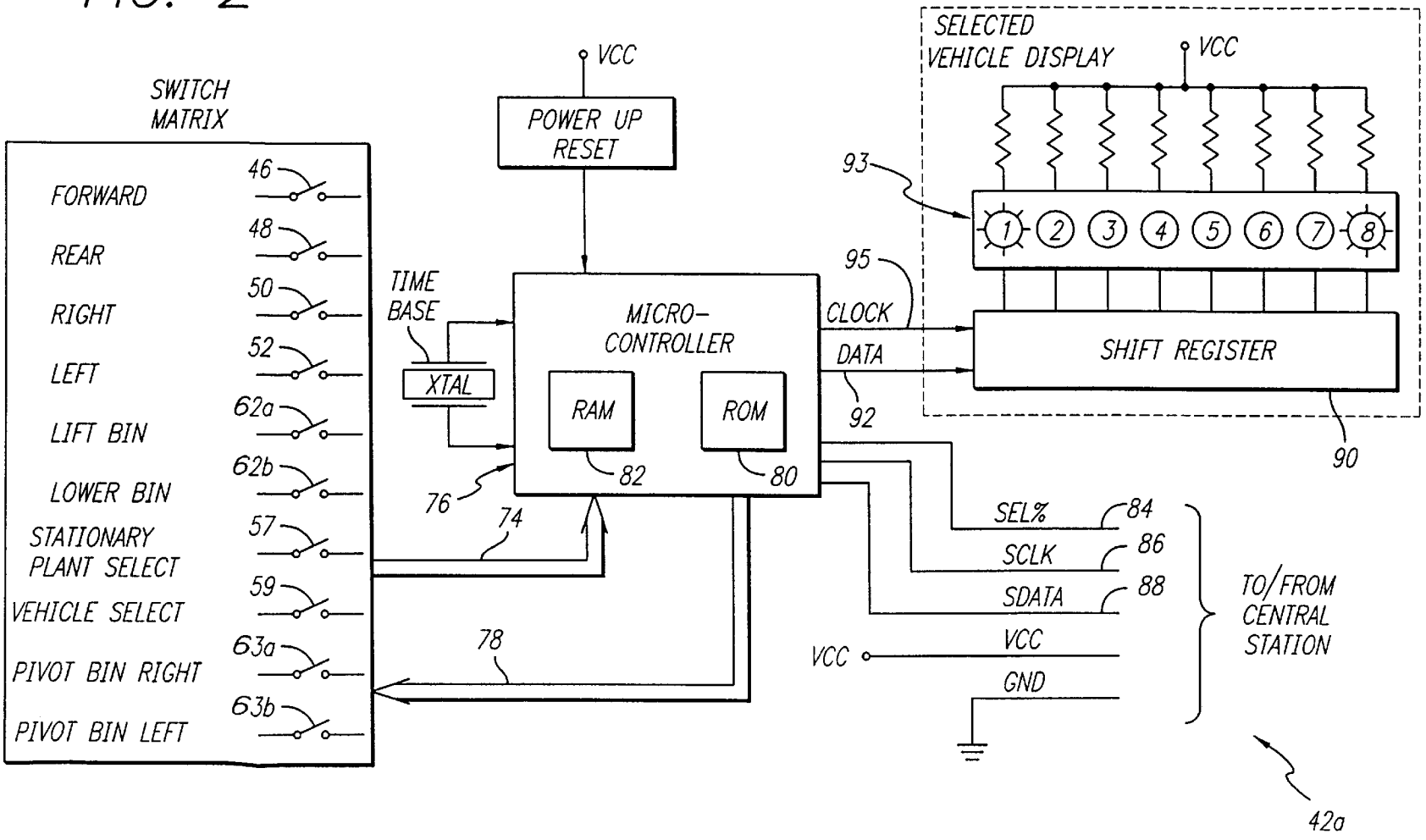
FIG. 2 is a schematic diagram, primarily in block form, of a control pad control system incorporated in the system shown in FIG. 1.

Each of the control pads 42*a*, 44*b*, 42*c* and 42*d* includes a button 56 (FIG. 1) connected to switch 57 (FIG. 2). Successive depressions of the button 56 within a particular period of time cause different ones of the stationary accessories or plants such as pumping station 34 and conveyer 38. For example, a first depression of the button 56 in one of the control pads 42*a*, 42*b*, 42*c* and 42*d* may cause the pumping station 34 to be energized and a second depression of the button 56 within the particular period of time in such control pad may cause the conveyor 38 to be energized. When other stationary accessories are included in the system 10, each may be individually energized by depressing the button 56 a selective number of times within the particular period of time. When the button 56 is depressed twice within the particular period of time, the energizing of the pumping station 34 is released and the conveyor 38 is energized. This energizing of a selective one of the stationary accessories occurs at the end of the particular period of time.

A vehicle selection button 58 is provided in each of the control pads 42*a*, 42*b*, 42*c* and 42*d* to select one of the vehicles 12, 14, 16 and 17. The individual one of the vehicles 12, 14, 16 and 17 selected at any instant by each of the control pads 42*a*, 42*b*, 42*c* and 42*d* is dependent upon the number of times that the button is depressed in that control pad within a particular period of time. For example, one (1) depression of the button 58 may cause the dump truck vehicle 12 to be selected and two (2) sequential selections of the button 58 within the particular period of time may cause the fork lift 14 to be selected.

Every time that the button 58 is actuated or depressed within the particular period of time, a switch 59 (in FIG. 2) is closed. The particular period of time for depressing the button 58 may have the same duration as, or a different time than, the particular period of time for depressing the button 56. An adder is included in the control pad 42 to count the number of depressions of the button 58 within the particular period of time. The count is converted into a plurality of binary signals indicating the count. The count is provided at the end of the particular period of time. Each individual count provides for a selection of a different one of the vehicles 12, 14, 16 and 17. The count representative of the selection of one of the vehicles 12, 14, 16 and 17 is maintained in a memory, which may be located either in the control pads 42*a*, 42*b*, 42*c* and 42*d*, or in the central station 64.

The control pads 42*a*, 42*b*, 42*c* and 42*d* include buttons 60*a* and 60*b*. When depressed, the buttons 60*a* and 60*b* respectively close switches 62*a* and 62*b* in FIG. 2. The closure of the switch 62*a* is instrumental in producing an operation of the motor 32 to lift the bin 18 in the dump truck 12 when the dump truck has been selected by the proper number of depressions of the button 58. In like manner, when the dump truck 12 has been selected by the proper number of depressions of the switch 58, closure of the switch 62*b* causes the bin 18 in the dump truck 12 to move downwardly as a result of the operation of the motor 32 in the reverse direction.

It will be appreciated that other controls may be included in each of the control pads 42*a*, 42*b*, 42*c* and 42*d*. For example, buttons 61*a* and 61*b* may be included in each of the control pads 42*a*, 42*b*, 42*c* and 42*d* (FIG. 1) which operate upon depression to close respective second accessory switches 63*a* and 63*b* (FIG. 2) to pivot the bin 18 to the right or left when the vehicle 12 has been selected. Such pivotal movements of bin 18 facilitate loading, transportation and unloading of transportable elements such as marbles 26 or blocks 24. It will be appreciated that different combinations of buttons may be actuated simultaneously to produce different combinations of motions. For example, a bin in a selected one of the vehicles may be moved at the same time that the selected one of the vehicles is moved.

A central station, generally indicated at 64 in FIG. 1, processes the signals from the individual ones of the control pads 42*a*, 42*b*, 42*c* and 42*d* and sends the processed signals to the vehicles 12, 14, 16 and 17 when the button 58 on an individual one of the control pads has been depressed to indicate that the information form the individual ones of the pads is to be sent to the vehicles. The transmission may be on a wireless basis from an antenna 68 (FIG. 1) in the central station to antennas 69 on the vehicles.

The transmission may be in packets of signals. This transmission causes the selected ones of the vehicles 12, 14, 16, 17 and 350 to perform individual ones of the functions directed by the depression of the different buttons on the individual ones of the control pads. When the commands from the individual ones of the control pads 42*a*, 42*b*, 42*c* and 42*d* are to pass to the stationary accessories 34 and 38 as a result of the depression of the buttons 56 on the individual ones of the pads, the central station process the commands and sends signals through cables 70 to the selected ones of the stationary accessories.

FIG. 2 shows the construction of the control pad 42*a* in additional detail. It will be appreciated that each of the control pads 42*b*, 42*c* and 42*d* may be constructed in a substantially identical manner to that shown in FIG. 2. As shown in FIG. 2, the control pad 42*a* includes the switches 46, 48, 50 and 52 and the switches 57, 59, 62*a*, 62*b*, 63*a* and 63*b*. Buses 74 are shown as directing signals from the switches 46, 48, 50, 52, 57, 59, 62*a*, 62*b*, 63*a* and 63*b* to a microcontroller, generally indicated at 76 in FIG. 2. Buses 78 are shown for directing signals from the microcontroller 76 to the switches.

The microcontroller 76 is shown as including a read only memory (ROM) 80 and a random access memory (RAM) 82. Such a microcontroller may be considered to be standard in the computing industry. However, the programming in the microcontroller and the information stored in the read only memory 80 and the random access memory 82 are individual to this invention.

The read only memory 80 stores permanent information and the random access memory stores volatile (or impermanent) information. For example, the read only memory 80 may store the sequence in which the different switches in the control pad 42*a* provide indications of whether or not they have been closed. The random access memory 82 may receive this sequence from the read only memory 80 and may store indications of whether or not the switches in the particular sequence have been closed for each individual one of the control pads 42*a*, 42*b*, 42*c* and 42*d*.

The control pad 42*a* in FIG. 2 receives the interrogating signals from the central station 64 through a line 84. These interrogating signals are not synchronized by clock signals on a line 86. Each of the interrogating signals intended for the control pad 42*a* may be identified by an address individual to such control pad. When the control pad 42*a* receives such interrogating signals, it sends to the central station 64 through lines 88 a sequence of signals indicating the status of the successive ones of the switches 46, 48, 50 and 52 and the switches 57, 59, 62*a*, 62*b*, 63*a* and 63*b*. These signals are synchronized by the clock signals on the line 86. It will be appreciated that the status of each of the switches 57 and 59 probably is the first to be provided in the sequence since these signals indicate the selection of the stationary accessories 34 and 38 and the selection of the vehicles 12, 14, 16 and 17.

As previously indicated, the control pad 42*a* selects one of the vehicles 12, 14, 16 and 17 in accordance with the number of closings of the switch 59. As the user of the control pad 42*a* provides successive actuations or depressions of the button 58, signals are introduced to a shift register 90 through a line 92 to indicate which one of the vehicles 12, 14, 16 and 17 would be selected if there were no further depressions of the button. Each one of the depressions of the button 58 causes the indication to be shifted to the right in the shift register 90. Such an indication is provided on an individual one of a plurality of light emitting diodes (LED), generally indicated at 93. The shifting of the indication in the shift register 90 may be synchronized with a clock signal on a line 95. Thus, the illuminated one of the light emitting diodes 93 at each instant indicates at that instant the individual one of the vehicles 12, 14, 16 and 17 that the control pad 42*a* has selected at such instant.

The central station 64 is shown in additional detail in FIG. 3. It includes a microcontroller, generally indicated at 94, having a read only memory (ROM) 96 and a random access memory (RAM) 98. As with the memories in the microcontroller 76 in the control pad 42*a*, the read only memory 96 stores permanent information and the random access memory 98 stores volatile (or impermanent) information. For example, the read only memory 96 sequentially selects successive ones of the control pads 42*a*, 42*b*, 42*c* and 42*d* to be interrogated on a cyclic basis. The read only memory 96 also stores a plurality of addresses each individual to a different one of the vehicles 12, 14, 16 and 17.

Since the read only memory 96 knows which one of the control pads 42*a*, 42*b*, 42*c* and 42*d* is being interrogated at each instant, it knows the individual one of the control pads responding at that instant to such interrogation. The read only memory 96 can provide this information to the microcontroller 94 when the microcontroller provides for the transmittal of information to the vehicles 12, 14, 16 and 17. Alternatively, the microcontroller 76 in the control pad 42*a* can provide an address indicating the control pad 42*a* when the microcontroller sends the binary signals relating to the status of the switches 46, 48, 50 and 52 and the switches 57, 59, 62*a*, 62*b*, 63*a* and 63*b* to the central station 64.

As an example of the information stored in the random access memory 98 in FIG. 3, the memory stores information relating to each pairing between an individual one of the control pads 42*a*, 42*b*, 42*c* and 42*d* and a selective one of the vehicles 12, 14, 16 and 17 in FIG. 1 and between each individual one of such control pads and a selective one of the stationary accessories 34 and 38. The random access memory 98 also stores the status of the operation of the switches 46, 48, 50 and 52 for each control pad and the operation of the switches 57, 59, 62*a*, 62*b*, 63*a* and 63*b* for each control pad.

When the central station 64 receives from the control pad 42*a* the signals indicating the closure (or the lack of closure) of the switches 46, 48, 50 and 52 and the switches 57, 59, 62*a*, 62*b*, 63*a* and 63*b*, the central station retrieves from the read only memory 96 the address of the individual one of the vehicles indicated by the closures of the switch 59 in the control pad. The central station may also retrieve the address of the control pad 42*a* from the read only memory 96.

The central station 64 then formulates in binary form a composite address identifying the control pad 42*a* and the selected one of the vehicles 12, 14, 16 and 17 and stores this composite address in the random access memory 98. The central station 64 then provides a packet or sequence of signals in binary form including the composite address and including the status of the opening and closing of each of the switches in the control pad 42*a*. This packet or sequence indicates in binary form the status of the closure each of the switches 46, 48, 50 and 52 and the switches 57, 59, 62*a*, 62*b*, 63*a* and 63*b*.

Each packet of information including the composite addresses and the switch closure information for the control pad 42*a* is introduced through a line 102 (FIG. 3) to a radio frequency transmitter 104 in the central station 64. The radio frequency transmitter 104 is enabled by a signal passing through a line 106 from the microcontroller 94.

When the radio frequency transmitter 104 receives the enabling signal on the line 106 and the address and data signals on the line 102, the antenna 68 (also shown in FIG. 1) transmits signals to all of the vehicles 12, 14, 16 and 17. However, only the individual one of the vehicles 12, 14, 16 and 17 with the address indicated in the packet of signals from the central station 64 will respond to such packet of signals.

The microcontroller 94 stores in the random access memory 98 the individual ones of the vehicles such as the vehicles 12, 14, 16 and 17 being energized at each instant by the individual ones of the control pads 42*a*, 42*b*, 42*c* and 42*d*. Because of this, the central station 64 is able to prevent the interrogated one of the control pads 42*a*, 42*b*, 42*c* and 42*d* from selecting one of the energized vehicles. Thus, for example, if the vehicle 14 is being energized by one of the control pads 42*a*, 42*b*, 42*c* and 42*d* at a particular instant, a first depression of the button 58 in the control pad being interrogated at that instant will cause the vehicle 12 to be initially selected and a second depression of the button by such control pad will cause the vehicle 14 to be skipped and the vehicle 16 to be selected.

Furthermore, in the example above where the control pad 42*a* has previously selected the vehicle 14, the microcontroller 94 in the central station 64 will cause the vehicle 14 to be released when the control pad 42*a* selects any of the vehicles 12, 350, 16 or 17. When the vehicle 14 becomes released, it becomes available immediately thereafter to be selected by any one of the control pads 42*a*, 42*b*, 42*c* and 42*d*. The release of the vehicle 14 by the control pad 42*a* and the coupling between the control pad 42*a* and a selected one of the vehicles 12, 14, 16, 17 and 350 are recorded in the random access memory 98 in the microcontroller 94.

The vehicles 12, 14, 16 and 17 are battery powered. As a result, the energy in the batteries in the vehicles 12, 14, 16 and 17 tends to become depleted as the batteries provide the energy for operating the vehicles. The batteries in the vehicles 12 and 14 are respectively indicated at 108 and 110 in FIG. 3. The batteries 108 and 110 are chargeable by the central station 64 because the central station may receive AC power from a wall socket via a transformer 65 and cable 65*a* (FIG. 1). The batteries are charged only for a particular period of time. This particular period of time is preset in the read only memory 96. When each battery is being charged for the particular period of time, a light 109 in a circuit with the battery becomes illuminated. The charging current to each of the batteries 108 and 110 may be limited by a resistor 111. The light 109 becomes extinguished when the battery has been charged. Charging capability is provided to system 10 by any of a number of possible configurations including locations in the junction box station 35 or as separate stationary plants or other types of accessories such as those depicted by 34 and 38 (FIG. 1) any of which may be placed conveniently throughout the system 10 as desired by the users.

Each central station 64 may have the capabilities of servicing only a limited number of control pads. For example, each central station 64 may have the capabilities of servicing only the four (4) control pads 42*a*, 42*b*, 42*c* and 42*d*. It may sometimes happen that the users of the system elect to service more than four (4) control pads. Under such circumstances, the microcontroller 94 in the central station 64 and a microcontroller, generally indicated at 94*a*, in a second central station corresponding to the central station 64 may be connected by cables 114*a* and 114*b* to an adaptor, generally indicated at 115.

One end of the cable 114*b* is constructed so as to be connected to a ground 117 in the adaptor 115. This ground operates upon the central station to which it is connected so that such central station is a slave to, or subservient to, the other central station. For example, the ground 117 in the adaptor 115 may be connected to the microcontroller 94*a* so that the central station including the microcontroller 94*a* is a slave to the central station 64. When this occurs, the microcontroller 94 in the central station 64 serves as the master for processing the information relating to the four (4) control pads and the four (4) vehicles in its system and the four (4) control pads and the four (4) vehicles in the other system.

The expanded system including the microcontrollers 94 and 94*a* may be adapted so that the address and data signals generated in the microcontroller 94*a* may be transmitted by the antenna 68 in the central station 64 when the central station 64 serves as the master station. The operation of the central station 64*a* may be clocked by the signals extending through a line 118 from the central station 64 to the adaptor 115 and through a corresponding line from the other central station to the adaptor.

The microcontroller 122 includes a read only memory (ROM) 124 and a random access memory (RAM) 126. As with the memories in the control pad 42*a* and the central station 64, the read only memory 124 may store permanent information and the random access memory 126 may store volatile (or impermanent) information. For example, the read only memory 124 may store information indicating the sequence of the successive bits of information in each packet for controlling the operation of the motors 28, 30, 32 and 33 in the vehicle 12. The random access memory 126 stores information indicating whether there is a binary 1 or a binary 0 at each successive bit in the packet.

The particular embodiment reflected by vehicle 12 includes a plurality of switches 128, 130 and 132. These switches are generally pre-set at the factory to indicate a particular Arabian number such as the number "5". However, the number can be modified by the user to indicate a different number if two central stations are connected together as discussed above and if both stations have vehicles identified by the numeral "5". The number can be modified by the user by changing the pattern of closure of the switches 128, 130 and 132. The pattern of closure of the switches 128, 130 and 132 controls the selection of an individual one of the vehicles such as the vehicles 12, 14, 16 and 17. Additional switches similar to the switches 128, 130 and 132 and configured to work in cooperation with such switches may be added to the vehicles to accommodate addressing of larger numbers of vehicles so that each may have its own unique address.

The pattern of closure of the switches 128, 130 and 132 in one of the vehicles can be changed when there is only a single central station. For example, the pattern of closure of the switches 128, 130 and 132 can be changed when there is only a single central station with a vehicle identified by the numeral "5" and when another user brings to the central station, from such other user's system, another vehicle identified by the numeral "5".

The vehicle 12 also includes a light such as a light emitting diode 134. This diode is illuminated when the vehicle 12 is selected by one of the control pads 42*a*, 42*b*, 42*c* and 42*d*. In this way, the other users can see that the vehicle 12 has been selected by one of the control pads 42*a*, 42*b*, 42*c* and 42*d* in case one of the users (other than the one who selected the vehicle 12) wishes to select such vehicle. It will be appreciated that each of the vehicles 12, 14, 16 and 17 may be generally different from the others so each vehicle may be able to perform functions different from the other vehicles. This is another way for each user to identify the individual one of the vehicles that the user has selected.

As previously described, the user of one of the control pads such as the control pad 42*a* selects the vehicle 12 by successively depressing the button 58 a particular number of times within a particular time period. This causes the central station 64 to produce an address identifying the vehicle 12. When this occurs, the central station 64 stores information in its random access memory 98 that the control pad 42*a* has selected the vehicle 12. Because of this, the user of the control pad 42*a* does not thereafter have to depress the button 58 during the time that the control pad 42*a* is directing commands through the station 64 to the vehicle 12. As long as the buttons on the control pad 42*a* are depressed within a particular period of time to command the vehicle 12 to perform individual functions, the microprocessor 94 in the central station 64 will direct the address of the vehicle 12 to be retrieved from the read only memory 96 and to be included in the packet of the signals transmitted by the central station to the vehicle 12.

The read only memory 96 in the microprocessor 94 at the central station 64 stores information indicating a particular period of time in which the vehicle 12 has to be addressed by the control pad 42*a* in order for the selective coupling between the control pad and the vehicle to be maintained. The random access memory 98 in the microcontroller 94 stores the period of time from the last time that the control pad 42*a* has issued a command through the central station 64 to the vehicle 12. When the period of time in the random access memory 98 equals the period of time in the read only memory 96, the microcontroller 94 will no longer direct commands from the control pad 42*a* to the vehicle 12 unless the user of the control pad 42*a* again depresses the button 58 the correct number of times within the particular period of time to select the vehicle 12.

The vehicle 12 also stores in the read only memory 124 indications of the particular period of time in which the vehicle 12 has to be addressed by the control pad 42*a* in order for the selective coupling between the vehicle and the control pad to be maintained. This period of time is the same as the period of time specified in the previous paragraph. The random access memory 126 in the microcontroller 122 stores the period of time from the last time that the control pad 42*a* has issued a command to the vehicle 12.

Once the particular button 58 of particular pad has been actuated to select and energize a vehicle, that vehicle remains operative and associated with such particular pad for a predetermined period of time as dictated by random access memory 126. When the period of time stored in the random access memory 126 of the microcontroller 122 in the vehicle equals the period of time in the read only memory 124, the microcontroller 122 issues a command to extinguish the light emitting diode 134. This indicates to the different users of the system, including the user previously controlling the operation of the vehicle 12 that the vehicle is available to be selected by any one of the users, including the user previously directing the operation of that vehicle.

When one of the vehicles such as the vehicle 12 is being moved in the forward direction, the random access memory 126 records the period of time during which such forward movement of the vehicle 12 is continuously occurring. This count is continuously compared in the microcontroller 122 with a fixed period of time recorded in the read only memory 124. When the period of time accumulated in the random access memory 126 becomes equal to the fixed period of time recorded in the read only memory 124, the microcontroller 122 provides a signal for increasing the speed of the movement of the vehicle 12 in the forward direction. Similar arrangements are provided for each of the vehicles 14, 16 and 17. This increased speed may illustratively be twice that of the original speed.

The system and method described above have certain important advantages. They provide for the operation of a plurality of vehicles by a plurality of users, either on a competitive or a cooperative basis. Furthermore, the vehicles can be operated on a flexible basis in that a vehicle can be initially selected for operation by one user and can then be selected for operation by another user after the one user has failed to operate the vehicle for a particular period of time. The vehicles being operated at each instant are also visible by the illumination of the lights 134. The apparatus and method of this invention are also advantageous in that the vehicles are operated by the central station 64 on a wireless basis without any physical or cable connection between the central station and the vehicles.

Furthermore, the central station 64 communicates with the vehicles in the plurality through a single carrier frequency. The system and method of this invention are also advantageous in that the vehicles can selectively perform a number of different functions including forwardly and rearwardly movement, as well as turns to the left and to the right, and manipulation of accessories such as containers, bins or platforms carried on the respective vehicles. Different movements can also be provided simultaneously on a coordinated basis. Vehicles may also be employed in a cooperative manner to work with stationary plants and accessories 34 and 38 for the movement and storage of materials such as blocks 24 and marbles 26.

Figure 5:
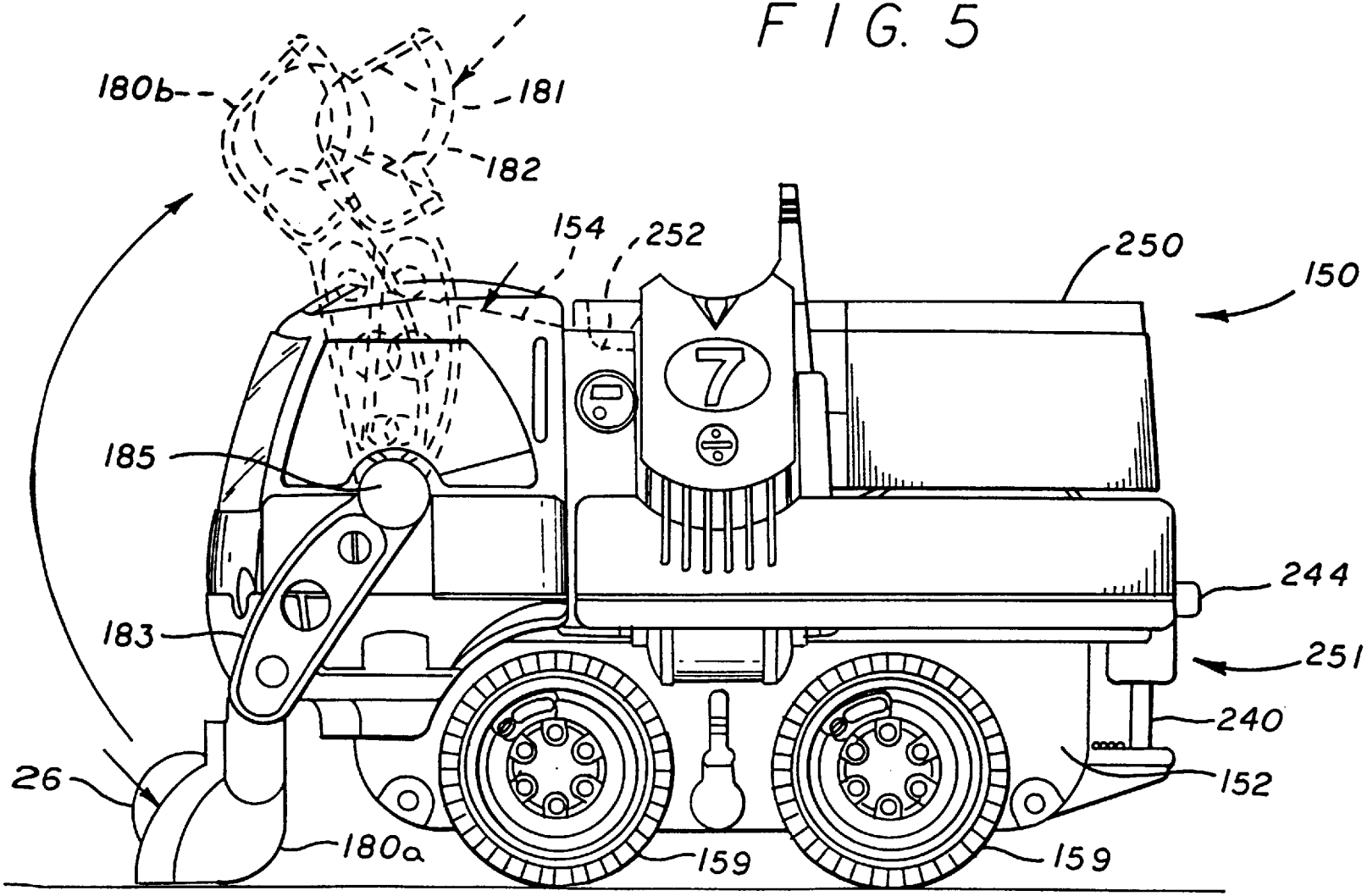
FIG. 5 is a side view, in enlarged scale, of a vehicle which may be controlled by the system shown in FIG. 1.

Referring now to FIG. 5, a toy dump truck 150 having a chassis 152, four wheels 159, a scoop 180 and a hopper 250 is shown. A front and rear left pair of wheels 159 is driven by the motor 28, and a front and rear right pair of wheels 159 is driven by the motor 30 Four axles (not shown) are rotatably mounted at a proximal end to the chassis 152, and one of the four wheels 159 is mounted on the distal end of each axle. Each axle may be the same length, or they may have different lengths, dependent on the needs of the designer of the vehicle.

A scoop arm shaft 185 is rotatably mounted on and extends through the chassis 152 of the dump truck 150 at a forward end of the dump truck 150. The scoop arm shaft 185 is sufficient long so that the opposing ends of the shaft extend beyond the right and left sides of the chassis 152. A pair of scoop arms 183 are fixedly mounted at their proximal ends on the right and left extending ends of the scoop arm shaft 185.

The scoop 180 is generally bin shaped and is operable to pick up transportable objects such as the marble 26 shown. The inside of the scoop 180 is generally frustroconical in section, having a forward side 181 and a rear side 182 that slope from the opening of the scoop 180 towards the bottom of the scoop 180. When the scoop 180 is in a first, lowered position, the forward side of the scoop 181 is generally parallel to the surface on which the dump truck 150 is operation. The slope and shape of the rear side 182 of the scoop 180 is configured to assist in retaining transportable objects, such as the marble 26, in the interior of the scoop 180 until the scoop has been lifted to a second, elevated, position, at which position the marble 26 or other transportable element may fall out of the scoop 180.

The chassis 152 includes a ramp portion 154. Objects such as the marble 26 falling out of the scoop 180 when the scoop has achieved the second position may fall upon the ramp 154 and be directed by the slope of the ramp 154 into the hopper 250. The hopper 250 has a front end 252 and a rear end 255. The rear end 255 of the hopper 250 is pivotally to the chassis 152 such that the front end 252 of the hopper 250 raises when the hopper 250 is pivoted about its rear end 255 when the dump truck 150 is controlled by an operator to empty the hopper 250. The bottom of the hopper 250 slopes from the front end 252 towards the rear end 255, directing objects such as the marble 26 down the slope of the bottom towards the rear end 182 to facilitate emptying of the hopper 250 when the hopper 250 is raised.

A hitch assembly 251 having a hitch pin 240 for attaching cables or trailers and a thumb tab 244 for manually raising the hitch pin 240 to open the hitch 251 is mounted to a rear end of the chassis 152. As will be described in more detail below, the hitch 251 may also be automatically opened and closed in coordination with the raising and lowering of the scoop 180 and hopper 250.

Figure 6:
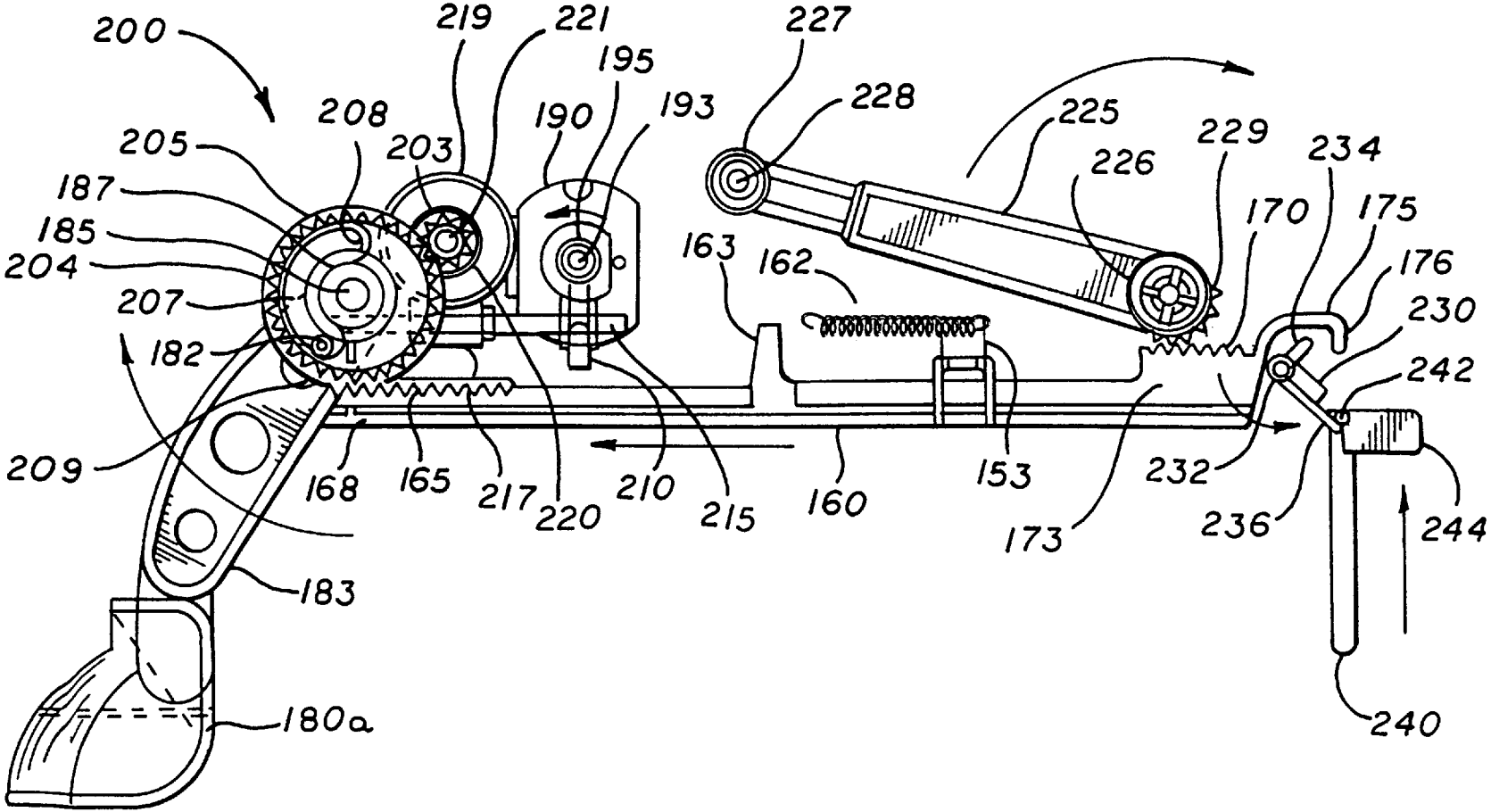
FIG. 6 is a partial break-away view depicting an embodiment of a motorized mechanism incorporated in the vehicle shown in FIG. 5.

Referring now to FIG. 6, a novel arrangement of motors, gears and arms for lifting and lowering the scoop 180 and the hopper 250 and opening and closing the hitch 251 is depicted. As will be apparent in view of the description below, this arrangement provides for coordinated lifting and lowering of the scoop 180 and the hopper 250, and operation of the hitch 251 using a single motor 190. A preferred embodiment of the invention arranges the gears, and provides for selected gear ratios and timing to coordinate the raising and lowering of the scoop 180 and the hopper 250 to prevent a collision between the scoop 180 and the front end 252 of the hopper 250 when the scoop 180 and hopper 250 are raised. This mechanical arrangement allows the overall length of the chassis 152 to be minimized to ensure adequate mobility within model environments, while still allowing useful and realistic operation of the scoop 180 and the hopper 250.

As shown in FIG. 6, an elongated member 160 is slidably mounted to the chassis 152. The elongated member 160 has a forward end 168, disposed toward the forward end of the chassis 152, and a rearward end 173, disposed towards the rear of the chassis 152. A forward gear rack 165 is formed on the forward end 168 and a rear gear rack 170 is formed near the rearward end 173. A tab 163 is located approximately midway between the forward end 168 and the rearward end 178. The rearward end 178 is formed in the general shape of a hook having a downward extending end 176. One end of a spring 162 is connected to a boss 153 that is mounted on the chassis 152 and the other end of the spring 162 is attached to the tab 163 to bias the elongated member 160 in a rearward direction.

The motor 190 is mounted to the chassis 152 and has a rotatable shaft 193 that may be rotated in either a clockwise or counterclockwise direct by the motor 190 in response to signals received from the central station 64. A gear 195 is fixedly attached to the shaft 193. A shaft 215 is rotatably mounted to the chassis 152, and has gear 210 fixedly mounted on one end of the shaft such that the teeth of gear 210 are engaged with the teeth of gear 195. A worm gear 217 is fixedly mounted on the other end of the shaft 215 and rotates in coordination with gear 210. A clutch gear 219, whose teeth are meshed with the teeth of the worm gear 217, is fixedly mounted on a shaft 221 that is rotatably mounted to the chassis 152. A gear 220 is also fixedly mounted on shaft 221, and is meshed with a gear 204 that is fixedly mounted on the scoop arm shaft 185.

The proximal end of the scoop arm 183 is fixedly mounted on the scoop arm shaft 185, and raises and lowers in coordination with the rotation of gear 204. A rack gear 205 is rotatably mounted on the scoop arm shaft 185 such that the rack gear 205 may rotate independent of the rotation of the scoop arm shaft 185. An arcuate delay slot 207 having a leading edge 208 is formed in the body of the rack gear 205. A pin 182 is mounted adjacent the proximal end of the scoop arm 183, and extends through arcuate delay slot 207. The length of the arcuate delay slot 207 may be chosen to allow the scoop arm 183 to rise to a selected height before the pin 182 engages the leading edge 208 of the rack gear 205. The rack gear 205 is meshed with the forward gear rack 165 of the elongated member 160.

A rear end of a lifter arm 225 is rotatably mounted on a shaft 226 that is in turn mounted to the chassis 152. The rear end of the lifter arm 225 may be rounded, and has a gear segment 229 formed on a portion of the rounded end. The teeth of the gear segment 229 are meshed with the teeth of the rear rack gear 173 of the elongated member 160. A forward end of the lifter arm 225 is rotatably mounted on a shaft 228 that is mounted to the underside of the hopper 250.

A hitch pin lever 230 is rotatably mounted on a shaft 232 mounted to the chassis 152. Alternatively, the hitch pin lever 230 and shaft 232 may be formed in one piece such that the shaft 232 comprises a pair of generally cylindrical tabs extending laterally and perpendicularly from each side of the hitch pin lever 230 with the cylindrical tabs being pivotally mounted to the chassis 152. The hitch pin lever 230 has a tab 234 that extends in an upward direction to engage the downwardly extending tab 176 of the elongated member 160. The hitch pin lever 230 also has a lever arm 236 that extends towards and engages with a pin 242 mounted on an upper end of the hitch pin 240 adjacent to the thumb tab 244.

In operation, the toy dump truck 150 may move from point to point, scooping up one or more marbles 26 and loading them into the hopper 250. The dump truck 150 may also hitch up to a trailer or another vehicle with the hitch pin 240 and tow the vehicle or trailer to another location. The dump truck may also move to another location, such as a loading dock accessory as described below in reference to FIG. 7, or the pumping station 34 or the conveyor 38 (FIG. 1) and empty the marbles 26 from the hopper 250 into a bin (not shown) on the loading dock, the pumping station 34 or the conveyor 38. All of these actions are taken in response to signals transmitted by the central station 64.

For loading transportable elements onto the vehicle 150, the motors 28 and 30 (FIG. 4) are operated to drive the wheels 159 to move the dump truck 150 forward until the marble 26 is contained by scoop 180, as shown in FIG. 5. Once the marble 26 is contained by the scoop 180, the motor 32 (FIG. 4) is controlled to rotate shaft 193, and thus gear 195, in a counterclockwise direction. Gear 210 meshes with gear 195 such that when gear 195 rotates in a counterclockwise direction, gear 210 will rotate in a clockwise direction, driving shaft 215 to rotate clockwise. This clockwise rotation is transmitted by shaft 215 to worm gear 217, which drives the clutch gear 219 in a counterclockwise direction, which in turn causes shaft 221 and pinion gear 203 to rotate counterclockwise. As gear 203 rotates counterclockwise, gear 204 which is fixedly mounted on the scoop arm shaft 185 is driven in a clockwise direction, rotating the scoop arm 183 upwards and lifting the scoop 180.

As the scoop arm 183 is rotated upwards, the pin 182 mounted on the scoop arm 183 moves within the arcuate delay slot 207 until the pin 182 engages the leading edge 208 of the arcuate delay slot 208. Upon engagement of the pin 182 with the leading edge 208, further clockwise upwards rotation of the scoop arm 183 causes the rack gear 205 to rotate in a clockwise direction. Since the rack gear 205 is fixedly mounted to the chassis 152 with respect to the elongated member 160 which is slidably mounted to the chassis 152, clockwise rotation of the rack gear 205 causes the meshed teeth of the forward gear rack 165, and thus the elongated member 160, to move in a forward direction.

As the elongated member 160 moves in forwardly, the teeth of the rear gear rack 173 disposed adjacent the rear end of the elongated member 160 also move in a forward direction, assisted by the bias provided by the spring 162, rotating the segment gear 229 meshed with the rear gear rack 173 in a clockwise direction. This clockwise rotation of segment gear 229 causes the lift arm 225 to rotate in a clockwise manner, raising the forward end 227 of the lift arm 225 upwards. As the forward end 227 of the lift arm 225 moves upwards, the front end of the hopper 250 is raised, pivoting the rear end of the hopper 250 about the shaft 226.

If the operator continues to control the motor 190 to raise the scoop 180 further, the continued forward movement of the elongated member 160 will cause the tab 176 disposed on the rear end 175 of the elongated member 160 to engage the tab 234 on hitch pin lever 230, rotating the hitch pin lever 230 in a counterclockwise direction about the shaft 232. As the hitch pin lever 230 is rotated counterclockwise, lever arm 236 of the hitch pin lever 230 moves in an upward direction, engaging the pin 242 of the hitch pin 240, and raising the hitch pin 240 upwards, opening the hitch.

Similarly, when the motor is controlled to rotate shaft 195 in a clockwise direction, the rack gear 204 is rotated in a counterclockwise direction, lowering the scoop arm 183. As the scoop arm 183 lowers, pin 182 disengages from the leading edge 208 of the arcuate delay slot 20, and moves freely within the arcuate delay slot 207 until the pin engages the trailing edge 209 of the arcuate delay slot 207. Because the elongated member 160 is biased in a forward direction by the spring 162, the rack gear 205 which is meshed with the forward gear rack 165 of the elongated member 160 will not rotate, thus maintaining the elongated member 160 in a forward position, until the pin 182 engages the trailing edge 209 of the arcuate delay slot 207 of the rack gear 205.

Once the trailing edge 209 of the arcuate delay slot 207 as been engaged by the pin 182 as the scoop arm 183 is lowered, the rack gear 205 will be driven by pin 192 to rotate in a counterclockwise direction, causing the elongated to move in a rearward direction against the bias provided by the spring 162. The rearward movement of the elongated member 160 drives the segment gear 229 to rotate in a counterclockwise direction, lowering the lift arm 225 and lowering the hopper 250. The rearward movement of the elongated member 160 also causes the tab 176 of the rear end 176 of the elongated member 160 to move in a rearward direction, allowing the lever arm of the hitch pin lever to move downward, lowering the hitch pin 240 and closing the hitch.

The ratios and dimensions of the gears and elements described above are designed to allow the scoop 180 to be raised sufficiently to empty the contents of the scoop 180 in the hopper 250, and then rotate the hopper 250 upwardly and out of the way of scoop the 180 such that the upward movement of the hopper avoids contact with the backwards movement of the scoop 180 as the scoop 180 rotates about shaft 187. Similarly, when the hopper 250 is lowered, the mechanical arrangement described above causes the scoop 180 to move forwards sufficiently to avoid contact with the hopper 250 as the hopper 250 is lowered.

Figure 7:
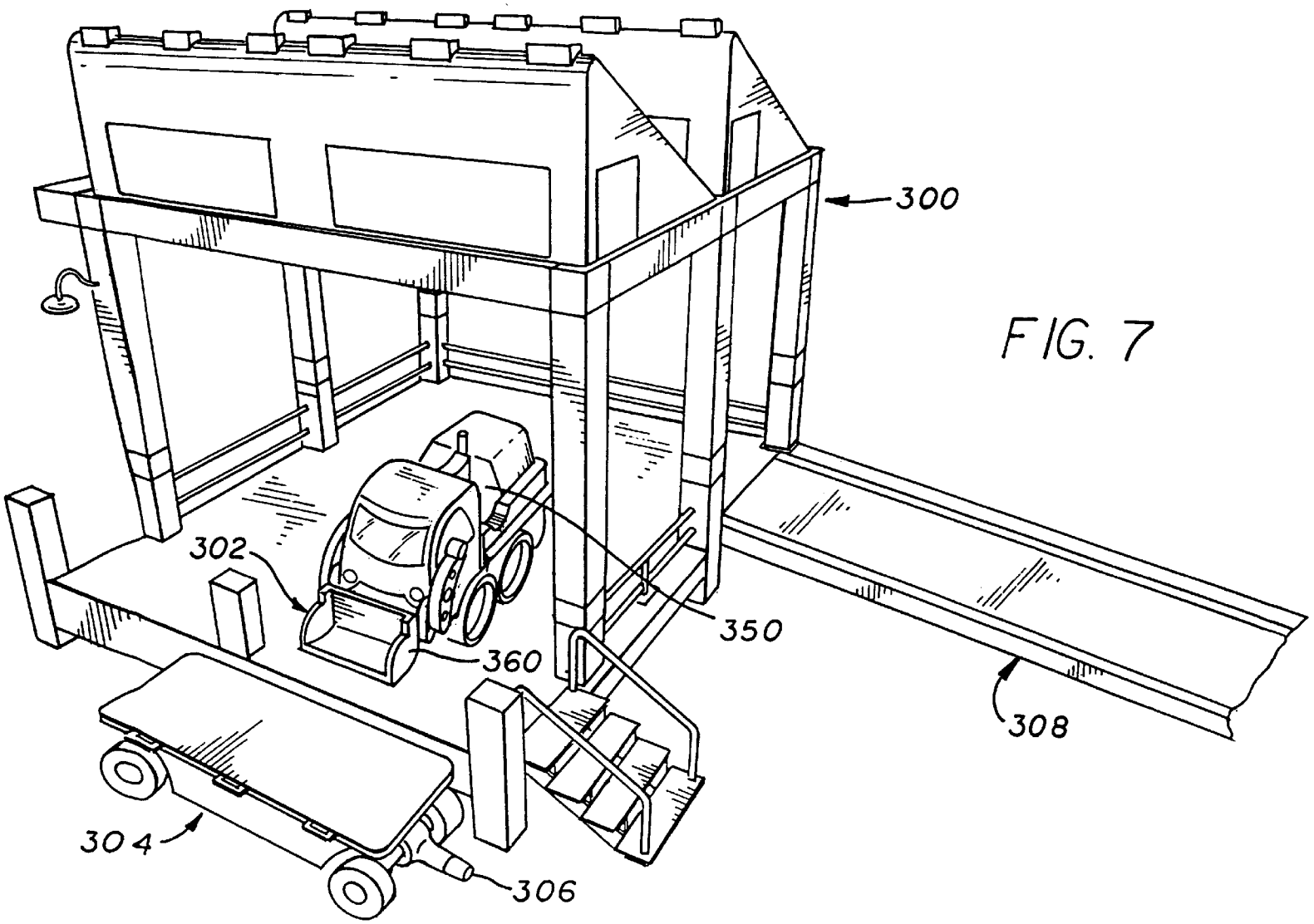
FIG. 7 is an elevational view of a loadingdock accessory illustrating an environment in which the toy vehicles of the present invention operate.
Figure 8:
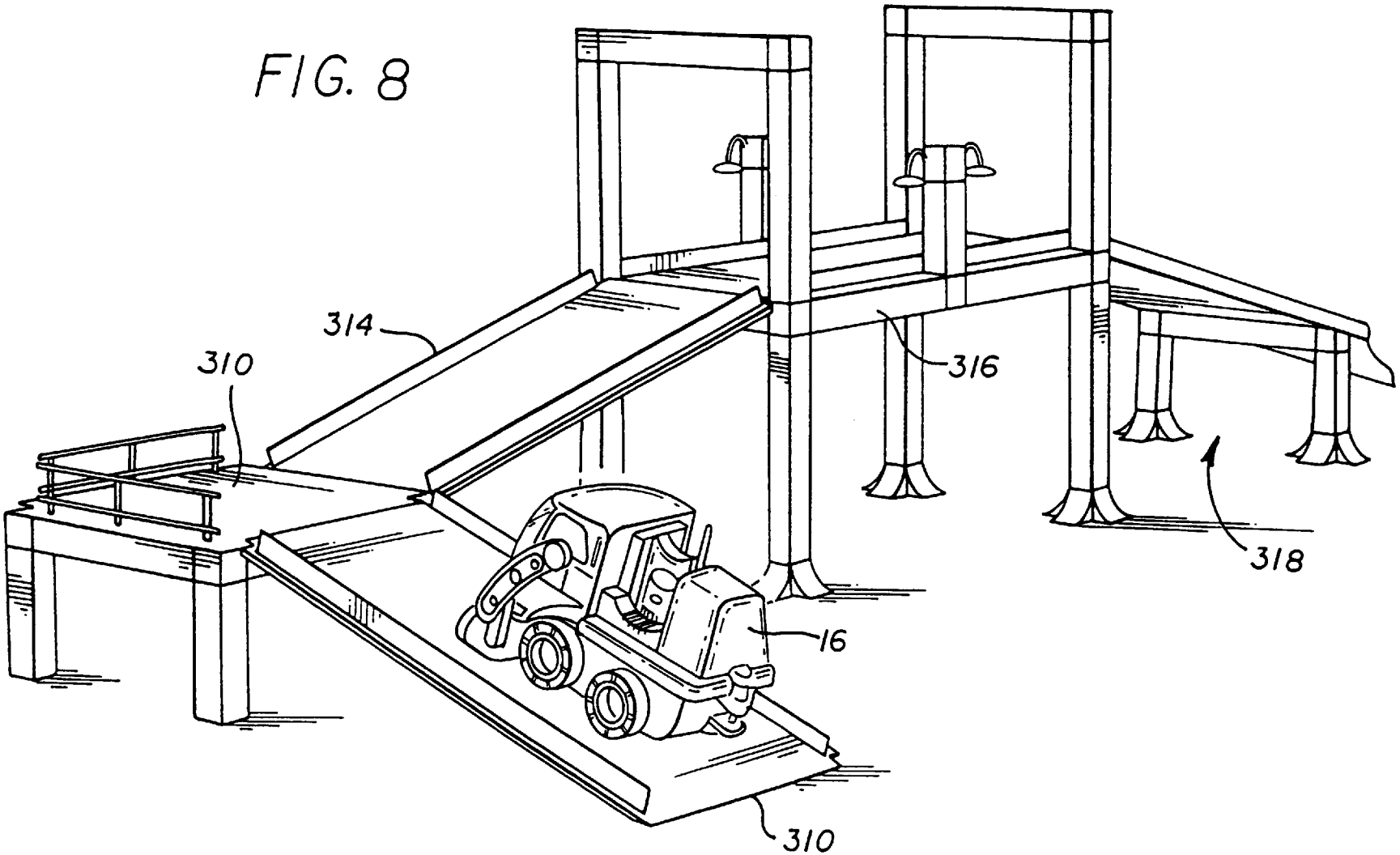
FIG. 8 is a side view of another embodiment of an accessory illustrating the play environment showing a toy bulldozer ascending a series of ramps before crossing a bridge.

Referring now to FIGS. 7 and 8, one novel aspect of the construction of the vehicles 12, 14, 16, 17 and 150 will now be described. FIG. 7 shows one embodiment of a fork lift 350 lifting and carrying a bin 302. The fork lift 350 is shown positioned on the raised deck of a miniature model of a loading dock, generally indicated at 300. Also shown in FIG. 7 is a trailer 304 that may be connected to the vehicles 12, 14, 16, 17 and 350 by connecting a tongue 306 of the trailer 304 to the hitch 19 of a selected one of the vehicles 12, 14, 16, 17, 150 and 350. As is apparent from FIG. 7, the fork lift 350 is capable of grasping the bin 302 with its gripper assembly and upon receiving the appropriate signal from the central station 64 (FIG. 1), can be operated to lift the bin to an elevated position. The operator may then control the fork lift 350 to move forward on the deck of the loading dock 300 until the bin 302 is suspended over the trailer 304. The fork lift can then be controlled to lower the bin 302 onto the trailer 304, and release the gripper assembly 360.

As is illustrated by FIGS. 7 and 8, various model environments can be constructed to provide for intriguing and enjoyable play by persons of youthful minds. Such model environments, however, may constrain the design and function of the vehicles 12, 14, 16, 17, 150 and 350 so that the vehicles may be easily operated within the environment. For example, the raised deck of the loading dock 300 in FIG. 7 is accessed by the fork lift 350 by ascending an inclined ramp 308. In operation, the vehicles 12, 14, 16, 17, 150 and 350 should be capable of climbing the ramp 308 to reach the raised deck of the loading dock 300 without suffering a loss of vehicle stability caused by the inclined attitude achieved by the vehicle as it ascends the ramp 308.

Additionally, the various structural accessories used with the system 10 may also be relatively small to maximize the use of available space. Such small accessories, such as the loading dock 300, may require that the vehicles 12, 14, 16, 17, 250 and 350 be capable of precise movements within the tight confines of such a structure. For example, after the fork lift 350 climbs the ramp 308, it must turn sharply to the left to gain access to the trailer 304. FIG. 8 depicts a further example of the operation of a vehicle 16 to climb a ramp 310, turn to the right on an intermediate deck 318, climb a second ramp 314, traverse a bridge 316, and then descend another ramp or series of ramps 318. Precise maneuverability of the fork lift 350 and the vehicle 16 avoids unnecessary jockeying of the vehicle backwards and forwards to accomplish the sharp turns required by the dimensions of the loading dock 300 (FIG. 7) and the intermediate deck 314 (FIG. 8).

In a preferred embodiment, the vehicles 12, 14, 16, 17, 150 and 350 accomplish the movements required to traverse the structures described above by employing skid steering. Skid steering of the vehicles 12, 14, 16, 17, 150 and 350 is accomplished by controlling, for example, motor 28 of the fork lift 350 to cause the wheels on the left side of the fork lift 350 to rotate to move the fork lift 350 in a forwardly direction. At the same instant, motor 30 of the fork lift 350 is not energized, thus the wheels 355 on the right side of the fork lift 350 do not rotate. Since only the wheels 355 on the left side of the fork lift 350 are controlled to move the vehicle forward, the fork lift 350 pivots to the right. Alternatively, motor 30 of the fork lift 350 may be controlled to rotate the wheels 355 on the right side of the fork lift 350 in the opposite direction to the wheels 355 driven by motor 28 on the left side of the fork lift 350. In this manner, the fork lift 350 may be controlled to pivot rapidly to the right around its axis. Similarly, to turn to the left, motor 30 may be controlled to move the fork lift 350 in a forwardly direction, while motor 28 is either not energized, resulting in the wheels 355 on the left side of the fork lift 350 remaining stationary, or motor 28 may be controlled to drive the wheels on the left side of the fork lift 350 in the direction opposite to the wheels on the right side of the fork lift 350. While the concept of employing skid steering to steer a vehicle is well known in the art, the present invention controls the ratio of wheelbase and track dimensions of the vehicles 12, 14, 16, 17, 150 and 350 in combination with careful placement of counterweights to provide for optimal maneuverability and stability.

Providing sufficient maneuverability while maintaining vehicle stability on an incline is particularly important for enjoyable operation of the fork lift 350. As a bin 302 is raised by the gripper assembly 360 of the fork lift 350, the additional weight of the bin 302 and any contents of the bin, such as marbles 26 or blocks 24 (FIG. 1) may adversely affect the stability of the fork lift 350 when it is controlled by a user to move forwards or backwards, or to turn to the right or left. Accordingly, the details of the embodiment of the present invention illustrating the improved maneuverability and stability of the vehicles 12, 14, 16, 17, 150 and 350 is described with reference to the fork lift 350. It will be understood, however, that the principles are equally applicable to each of the vehicles 12, 14, 16 and 17.

It has been determined during testing that maneuverability and stability of the fork lift 350, and thus the vehicles 12, 14, 16, 17 and 150, is optimized when the ratio of the track to the wheelbase of the fork lift 350 is approximately equal to 1.5. For example, a fork lift 350 having a track equal to 85 millimeters and a wheelbase equal to 55 millimeters has been found to have excellent maneuverability in the tight confines of representative model structures such as the loading dock 300 in FIG. 7, while also providing for stable operation of the fork lift 350 while ascending or descending inclined ramps as illustrated in FIGS. 7 and 8.

While several forms of the invention have been illustrated and described, it will also be apparent that various modifications can be made without departing from the spirit and scope of the invention. Accordingly, it is not intended that the invention be limited, except by the appended claims.

What is claimed is:

1. In combination:

a remotely-controlled toy loader truck including a chassis;

a first work arm mounted rotationally from a first location on said chassis for rotation from a first to a second position;

a second work arm mounted rotationally from a second location on said chassis;

a drive motor mounted on said chassis; and a drive mechanism coupled between said motor and said first and second arms and including a lost motion device operative, upon activation of said motor for rotation in one direction, to rotate said first arm through a predetermined arc from said first position without rotating the second arm and further operative, upon continued rotation of said motor in said one direction, to rotate said second arm.

2. In combination:

a remotely-controlled toy loader truck including a chassis having a longitudinal track;

an elongated gear rack received slidably in said track and formed with forward and rearward extremities configured with respective forward and rearward gear segments;

a first work arm mounted rotatably on one end from a forward portion of said chassis and projecting therefrom to be rotated between first and second positions;

a drive motor on said chassis;

a lost motion device coupled with said motor and including a first gear meshed with said forward gear segments and operative, upon activation of said motor in one direction, to initially rotate said first arm through a predetermined arc while leaving said gear rack at rest and, upon continued activation of said motor in said one direction, to rotate said first gear and drive said gear rack in an activation direction in said track; and a second work arm rotatably mounted rearwardly on said chassis and including a second gear meshing with said rearward gear segment to be rotated by said gear rack as it moves forwardly and rearwardly in said track.

3. In a combination as set forth in claim 2, said first gear including an arcuate slot and said lost motion device further including a drive pin carried from said first arm for movement in said arcuate slot as said first arm is rotated through said predetermined arc to contact one end of said arcuate slot to rotate said first gear with said first arm.

4. In a combination as set forth in claim 2, wherein said motor is operative upon activation in said one direction to rotate said first gear and drive said gear rack in said track through a predetermined path to an unhitching position, said rack including a catch, the combination further comprising:

a hitch pin including a drive tab movably mounted on said chassis and having a hitching position and an unhitching position; and a drive movably mounted from said chassis and including a follower disposed in the path of said catch, as said rack is moved to said unhitching position, to be engaged by said catch to move said drive from a hitching to an unhitching position, said drive being coupled with said drive motor and further including a driver engageable with said hitch pin as said drive is rotated to said unhitching position to move said hitch pin from said hitching to said unhitching position.

5. In a combination as set forth in claim 2, a spring device coupled between said chassis and said gear rack to bias said rack to a forwardly position.

6. In a combination as set forth in claim 2, support wheels carrying said chassis; and a device mounted on said chassis to drive said wheels.

7. In combination:

a plurality of remotely-controlled toy loader trucks including respective elongated chassis, respective first work arms mounted rotationally from respective first locations on the respective chassis for rotation from a respective first position to a respective second position, second work arms mounted rotationally from a second location, respective accessory drive motors, respective drive mechanisms coupled between respective said drive motors and the respective said first and second arms and including respective lost motion devices operative, upon actuation of the respective said motors for rotation in respective one directions, to rotate the respective said first arms through respective predetermined arcs from the respective said first positions without rotating the respective said second arms and further operative, upon continued rotation of the respective said accessory motors in the respective said one directions, to rotate the respective said second arms;

a plurality of accessory controls each mounted in an individual one of the respective trucks and operative in response to an individual plurality of selected control signals, each of the individual pluralities of the selected control signals bearing a unique identification code to operate the respective control; and a control device for coupling with said accessory controls including a plurality of control pad devices, each including respective control switches operable by an operator to generate said selected control signals.

8. In a combination as set forth in claim 7, wheels supporting the respective chassis and prime movers on the respective chassis for driving the respective wheels;

said accessory controls including respective selected control elements responsive to respective prime mover signals to operate the respective said prime movers;

accessory control pads including respective switches operative by an operator to generate said selected prime mover signals.

9. In a combination as set forth in claim 2, a liftable bin mounted on said chassis and formed with a liftable end connected to the free end of said second arm to be lifted thereby as said gear rack is moved forwardly in said track; and a scoop mounted to the free end of said first arm, said first arm and lost motion device being configured to cause said first arm, as it is moved from said first to said second position, to carry said scoop upwardly and rearwardly as it is moved into a dumping position disposed over said liftable end of said bin.

10. In a combination as set forth in claim 2, a bin with a liftable end, a scoop, said arms, lost motion device, bin and scoop being configured such that said first arm is operable to carry said scoop into a dumping position over said liftable end of said bin prior to the time said second arm initiates lifting of said liftable end.

11. In a combination as set forth in claim 9 wherein said arms, lost motion device, scoop and bin are configured such that said rack is operative upon being driven rearwardly as said first arm is rotated from said second to said first position, to move said scoop clear of the path defined by said liftable end of said bin as said second arm lowers said liftable end.

12. In a combination as set forth in claim 2, a central control station for sending signals to said truck to provide controlled movements of said truck forwardly and rearwardly and controlled turnable movements of said truck in opposite horizontal directions and controlled movements of said drive motor in such individual ones of upwardly and downwardly directions, said central control station providing signals with characteristics individual to said truck; and a plurality of control pads associated with said truck and each control pad having a plurality of controls individually operable to introduce to said central control station signals providing for the transmission to said truck by said central control station of signals indicating to said truck said drive motor and said lost motion device to be actuated and the type of actuation to be provided to said drive motor and said lost motion device in said truck.

13. In a combination as set forth in claim 12, said central control station including means for providing a signal having a common carrier frequency for said truck and for modulating the common carrier signal with signals identifying said truck and identifying to said drive motor and said lost motion device in said truck the operation to be performed on said drive motor and said lost motion device.

14. In a combination as set forth in claim 13, said truck including means for receiving said common carrier frequency signal from said central control station and for demodulating said modulations addressed to said truck to produce demodulated signals and for operating said drive motor and said lost motion device in said truck in accordance with such demodulated signals.

15. In a combination as set forth in claim 14, means in said truck for demodulating said signals modulated from said central control station with said address identifying said truck to produce demodulated signals and for operating said drive motor and said lost motion device in accordance with such demodulated signals.

16. In a combination as set forth in claim 14, at least one motorized accessory providing an individual operation when energized, said control pads in said plurality having additional controls for providing signals to said central control station for energizing said motorized accessory, said central control station including means responsive to said signals in said control pads in response to the operation of said additional controls for energizing said motorized accessory.

17. In combination as set forth in claim 8, a plurality of control pads each having a plurality of switches controlling the addressing of any of said trucks and controlling the selective energizing of said accessory controls in said addressed truck; and said control device big responsive to the selective operation of individual one of said switches in each individual one of said control pads in said plurality for providing for an operation of individual ones of said accessory controls in said addressed truck.

18. In a combination as set forth in claim 17, said control device being connected by at least one wire to said control pads in said plurality and communicating by wireless transmission to said addressed truck.

19. In a combination as set forth in claim 18, said control device providing common carrier signals for communication with said addressed truck and providing on said carrier signals modulations providing said address individual to said addressed truck and identifying the operation of said individual ones of the switches of said plurality in said control pad communicating with said addressed truck.

20. In a combination as set forth in claim 2, a control device for providing packets of signals for addressing said truck, means disposed on said truck for providing an indication that said truck has been addressed by said packets from said control device.

21. In a combination as set forth in claim 8, the control device providing packets of signals for addressing the addressed truck, means disposed on said addressed truck for providing an indication that said addressed truck has been addressed by said packets from said control device.

22. In combination as set forth in claim 2, a central control station for use with a plurality of control pads each having a plurality of individually operable controls and for use with said truck individually selectable in accordance with the operation of first selective ones of said controls in said individual ones of said control pads and each individually operable to perform selective ones of a plurality of operations in accordance with the operation of second selective ones of said controls in said individual ones of said control pads;

first means for receiving on a cyclic basis from successive ones of said control pads signals indicating the selection of said individual vehicle and the operation of individual ones of said first and said second controls in said successive ones of said control pads;

second means responsive to said signals indicating the selection of said truck by said successive ones of said control pads for producing addresses identifying said individual vehicle and identifying the selection of said truck by said successive ones of said control pads; and third means responsive to the production by said second means of said addresses identifying said individual vehicle for transmitting signals representing such addresses and signals indicating the operation of said controls in said successive ones of said control pads to obtain said selective ones of said operations in said individual vehicle.

23. In a combination as set forth in claim 22, said central control station being connected by at least one wire to said control pads and said central control station including an antenna for transmitting on a wireless basis to said truck said signals representing said addresses of said truck and the operation of said controls at said control pads to said truck.

24. In combination as set forth in claim 2, control means for providing packets of signals;

each packet including first binary signals providing a particular binary address of said truck in relation to binary addresses for other trucks and second binary signals following said first binary signals and providing binary indications of different controls to be provided in said truck for operating the truck;

said truck being usable with transportable elements;

first means for decoding said first binary signals in said packets from said control means with said particular binary address to activate said truck;

second means responsive to said second binary signals in said packets from said control means with said particular address for moving said truck in selective ones of forward and reverse directions and for turning said truck selectively to the right and to the left;

said first work arm in said truck having third means for receiving and holding said transportable elements and for providing a release of said transportable elements; and fourth means responsive to said second signals in said packets with said particular address for selectively operating said third means in receiving, holding and releasing said transportable elements.

25. In a combination as set forth in claim 24, fifth means in said truck for providing a visual indication of the activation of said truck during the period of time that said truck is activated.

26. In a combination as set forth in claim 24, fifth means including a plurality of switches manually operable in said truck to vary said binary address to which said truck responds in accordance with the pattern of said first binary signals from said control means.

27. In a combination as set forth in claim 26, sixth means in said truck for providing a visual indication of the addressing of said truck during the period of time that said truck is addressed; and seventh means including a plurality of switches manually operable in said truck to vary said binary address to which said truck responds in the pattern of said first signals from said control means.

28. In combination for use with transportable elements, a movable vehicle, motor means operatively coupled to the movable vehicle for providing a controlled movement of the movable vehicle, a scoop mounted on the movable vehicle for receiving and transporting the transportable elements in accordance with the movement of the movable vehicle, a bin mounted on the movable vehicle for receiving the transportable elements from the scoop, and a linkage drive coupled to the scoop and the bin and operative to initially raise the scoop to a position above the bin for a transfer of the transportable elements from the scoop to the bin and to subsequently move the scoop to a position for transport of the transportable elements in the scoop in accordance with the movements of the vehicle and to move the bin clear of the path of the subsequent movement of the scoop.

29. In a combination as set forth in claim 28 wherein the linkage device is operative to first move the scoop in a particular direction and then move the scoop and the bin in the particular direction.

30. In a combination as recited in claim 28, the vehicle having a chassis, a hitch having first and second operative relationships and mounted to the chassis for movement between the first and second operative relationships and operative in the first relationship to hitch the truck to a movable member and operative in the second relationship to unhitch the truck from the movable member, and a drive operatively coupled to the linkage device to change the hitch from the first relationship to the second relationship in accordance with the movements of the linkage device.

31. In a combination as set forth in claim 30 wherein the linkage device is operative initially to move the scoop in a particular direction and then move the scoop and the bin in the particular direction.

32. In combination for use with transportable elements, a movable vehicle, a motor means operatively coupled to the vehicle for providing a controlled movement of the vehicle, a scoop mounted on the vehicle for receiving and transporting the transportable elements, a bin mounted on the vehicle for receiving the transportable elements from the scoop, a first linkage device coupled to the scoop and initially operative to raise the scoop to a position above the bin for a transfer of the transportable elements from the scoop to the bin and subsequently operative to move the scoop to a position for transporting the transportable elements in the scoop in accordance with the movements of the vehicle, and a second linkage device operatively coupled to the bin and responsive to the movements of the scoop for moving the bin clear of the path of the scoop during the subsequent movement of the scoop.

33. In a combination as set forth in claim 32, a hitch having first and second operative relationships and operative in the first relationship to hitch the vehicle to a movable member and operative in the second relationship to unhitch the vehicle from the movable member, and a drive operatively coupled to the first linkage device to change the hitch from the first operative relationship to the second operative relationship in accordance with the movements of the first linkage device.

34. In a combination as set forth in claim 32, the initial and subsequent movements of the scoop being in a particular direction and the movement of the bin being in the particular direction.

35. In a combination as set forth in claim 33, the initial and subsequent movements of the scoop being in a particular direction and the movement of the bin being in the particular direction, and the changing of the hitch from the first operative relationship to the second operative relationship occurring during the initial movement of the scoop.

36. In combination, a movable vehicle, motor means operatively coupled to the vehicle for providing a controlled movement of the vehicle, a scoop mounted on the vehicle for receiving and transporting the transportable elements in accordance with the movements of the movable vehicle, a bin mounted on the vehicle for receiving the transportable elements from the scoop, a hitch having first and second operative relationships and operative in the first relationship to hitch a movable member to the movable vehicle and operative in the second relationship to unhitch the movable member from the vehicle, a movable linkage device, and a drive operatively coupled to the linkage device and the hitch to change the hitch from the first operative relationship to the second operative relationship in accordance with the movements of the linkage device.

37. In a combination as set forth in claim 36, the linkage device is operatively coupled to the scoop to move the scoop initially and subsequently in a particular direction.

38. In a combination as set forth in claim 36, the hitch including an end hook catch, a hitch pin and a hitch pin lever, and a drive mechanism operable in accordance with the movements of the linkage device to move the end hook catch, the hitch pin lever being engageable by the end hook catch in accordance with the movements of the end hook catch to move the hitch pin lever to a position to change the hitch from the first operative relationship to the second operative relationship.

39. In a combination as set forth in claim 36 wherein the linkage device includes a rack gear and the hitch includes a gear rack operatively coupled to the rack gear for movement with the rack gear.

40. In a combination as set forth in claim 28, a plurality of pads each manually operative to provide first binary indications for addressing the movable vehicle and second binary indications for providing commands to the movable vehicle to obtain an operation of the movable vehicle in accordance with such commands, the movable vehicle constituting a first movable vehicle, a plurality of second movable vehicles in addition to the first movable vehicle, each of the second movable vehicles in the plurality and the first movable vehicle having an individual address, and a central station operatively coupled to the pads in the plurality for sending the first and second binary indications from the pads in the plurality to the second vehicles in the plurality and the first movable vehicle to address individual ones of the first vehicle and the second vehicles in accordance with the first binary indications and to obtain an operation of such individual ones of the addressed vehicles in accordance with the second binary indications.

41. In a combination as set forth in claim 32, a plurality of manually held pads each manually operative to provide a first plurality of binary indications for addressing the movable vehicle and a second plurality of binary indications for operating the first and second linkage devices in the vehicle, and a central station for sending the first and second binary indications from individual ones of the pads to address the vehicle in accordance with the first binary indications and to operate the vehicle in accordance with the second binary indications.

42. In a combination as set forth in claim 41, the movable vehicle constituting a first vehicle, and a plurality of vehicles in addition to the first vehicle, each of the vehicles in the plurality and the first vehicle having an individual address, and the central station being operative to send the first and second binary indications from the pads in the plurality to the vehicles in the plurality and the first movable vehicle to address and operate such vehicles in accordance with the first and second binary indications from the pads in the plurality.

43. In a combination as set forth in claim 35, the movable vehicle constituting a first movable vehicle, a plurality of second movable vehicles in addition to the first movable vehicle, each of the second movable vehicles in the plurality including motor means operatively coupled to such vehicle for providing a controlled movement of such vehicle, a plurality of pads each manually operative to provide first binary indications for addressing an individual one of the second vehicles and the first vehicle and second binary indications for providing commands for operating such individual one of the vehicles, and a central station responsive to the first and second binary indications from the pads for sending the binary indications on a cyclic basis to the second vehicles and the first vehicle to obtain an operation of the vehicles addressed by the pads in accordance with the second binary indications from such pads.

* * * * *

UNITED STATES PATENT AND TRADEMARK OFFICE

CERTIFICATE OF CORRECTION

PATENT NO. : 5,964,640

DATED : Oct. 12, 1999

INVENTOR(S) : William M Barton, Lonnie C. Pogue, James A. Trinchera

It is certified that error appears in the above-identified patent and that said Letters Patent is hereby corrected as shown below:

Column 22, line 6, change "big", to read --being--.

Signed and Sealed this

Twenty-fifth Day of April, 2000

*Attest:*

Q. TODD DICKINSON

*Attesting Officer*

*Director of Patents and Trademarks*